US007682036B2

(12) United States Patent
Reiff et al.

(10) Patent No.: US 7,682,036 B2
(45) Date of Patent: Mar. 23, 2010

(54) INTRINSICALLY SAFE LIGHT

(75) Inventors: Paul J. Reiff, Bluffton, IN (US); David L. Reiff, Bluffton, IN (US); Clyde M. Brown, Hebron, IN (US)

(73) Assignee: General Manufacturing, Inc., Bluffton, IN (US)

( * ) Notice: Subject to any disclaimer, the term of this patent is extended or adjusted under 35 U.S.C. 154(b) by 0 days.

(21) Appl. No.: 11/286,818

(22) Filed: Nov. 23, 2005

(65) Prior Publication Data

US 2006/0109662 A1 May 25, 2006

Related U.S. Application Data

(63) Continuation-in-part of application No. 10/863,104, filed on Jun. 8, 2004, now Pat. No. 6,979,100, which is a continuation of application No. 10/119,555, filed on Apr. 10, 2002, now Pat. No. 6,857,756.

(60) Provisional application No. 60/283,002, filed on Apr. 11, 2001.

(51) Int. Cl.
*F21L 4/02* (2006.01)

(52) U.S. Cl. ..... 362/184; 362/197; 362/244; 362/800; 362/228

(58) Field of Classification Search ..... 362/184, 362/197, 228, 800; 315/307
See application file for complete search history.

(56) References Cited

U.S. PATENT DOCUMENTS

| | | | | |
|---|---|---|---|---|
| 3,982,120 | A | 9/1976 | Wynn | |
| 4,045,663 | A | 8/1977 | Young | |
| 4,115,842 | A | 9/1978 | Keller | |
| 4,228,485 | A | 10/1980 | Hubbard et al. | |
| 4,252,426 | A | 2/1981 | Kuraishi | |
| 4,290,095 | A | 9/1981 | Schmidt | |
| 4,325,107 | A | 4/1982 | MacLeod | |
| 4,346,329 | A | 8/1982 | Schmidt | |
| 4,398,139 | A | 8/1983 | Prinsze | |
| 4,634,936 | A * | 1/1987 | Gentry et al. | 315/307 |
| 4,843,298 | A | 6/1989 | Brauch et al. | |
| 4,876,632 | A | 10/1989 | Osterhout et al. | |
| 5,154,511 | A | 10/1992 | Veneskey | |
| 5,400,232 | A | 3/1995 | Wong | |

(Continued)

FOREIGN PATENT DOCUMENTS

| | | |
|---|---|---|
| EP | 0313285 | 2/1994 |

(Continued)

OTHER PUBLICATIONS

Web Brochure http://www.intrinsically-safe-instruments.com/intrinsically-safe-torches.html - Instrinsically Safe Torches and Handlamps, SA EX Instruments (Pty) Ltd - 2008, 7 pages.

(Continued)

*Primary Examiner*—Anabel M Ton
(74) *Attorney, Agent, or Firm*—Baker & Daniels LLP

(57) ABSTRACT

A work light for work or task areas which uses light-emitting diodes (LEDs) as the source of light. LED clusters are mounted on a circuit board which is located in a housing. The LED work lights may be powered by 3.6 volt, 4.8 volt, or 6.0 volt sources.

22 Claims, 15 Drawing Sheets

U.S. PATENT DOCUMENTS

| | | | | |
|---|---|---|---|---|
| 5,508,900 | A | 4/1996 | Norman | |
| 5,534,664 | A * | 7/1996 | Fearing et al. | 174/50 |
| 5,536,975 | A | 7/1996 | Jennings | |
| 5,653,529 | A | 8/1997 | Spocharski | |
| 5,685,636 | A | 11/1997 | German | |
| 5,738,436 | A | 4/1998 | Cummings et al. | |
| 5,871,272 | A * | 2/1999 | Sharrah et al. | 362/184 |
| 5,908,233 | A | 6/1999 | Heskett et al. | |
| 5,926,320 | A | 7/1999 | Parkyn, Jr. et al. | |
| 5,975,714 | A | 11/1999 | Vetorino et al. | |
| 5,975,719 | A | 11/1999 | Reiff et al. | |
| 6,095,661 | A | 8/2000 | Lebens | |
| 6,135,605 | A | 10/2000 | Hsu et al. | |
| 6,161,910 | A | 12/2000 | Reisenauer et al. | |
| 6,168,288 | B1 * | 1/2001 | St. Claire | 362/184 |
| 6,179,431 | B1 | 1/2001 | Chien | |
| 6,190,018 | B1 | 2/2001 | Parsons et al. | |
| 6,220,719 | B1 | 4/2001 | Vetorino et al. | |
| 6,231,207 | B1 | 5/2001 | Kennedy et al. | |
| 6,239,555 | B1 | 5/2001 | Rachwal | |
| 6,257,734 | B1 | 7/2001 | Tchira | |
| 6,296,370 | B1 | 10/2001 | Bamber et al. | |
| 6,299,323 | B1 | 10/2001 | Yu et al. | |
| 6,305,818 | B1 | 10/2001 | Lebens | |
| 6,328,456 | B1 | 12/2001 | Mize | |
| 6,331,062 | B1 | 12/2001 | Sinclair | |
| 6,357,890 | B1 | 3/2002 | Parsons et al. | |
| 6,357,893 | B1 | 3/2002 | Belliveau | |
| 6,366,028 | B1 | 4/2002 | Wener et al. | |
| 6,394,621 | B1 | 5/2002 | Hanewinkel, III | |
| 6,398,383 | B1 | 6/2002 | Huang | |
| 6,461,017 | B2 | 10/2002 | Selkee | |
| 6,461,024 | B1 | 10/2002 | Becker et al. | |
| 6,474,837 | B1 | 11/2002 | Belliveau | |
| 6,857,756 | B2 * | 2/2005 | Reiff et al. | 362/184 |
| 6,979,100 | B2 * | 12/2005 | Reiff et al. | 362/184 |
| 7,222,995 | B1 | 5/2007 | Bayat et al. | |
| 7,281,820 | B2 | 10/2007 | Bayat et al. | |
| 7,293,898 | B2 * | 11/2007 | Kumthampinij et al. | 362/294 |
| 7,402,961 | B2 | 7/2008 | Bayat et al. | |
| 7,461,944 | B2 * | 12/2008 | Alessio | 362/184 |
| 2001/0005316 | A1 | 6/2001 | Galli | |
| 2001/0012204 | A1 | 8/2001 | Sharrah et al. | |
| 2001/0026369 | A1 | 10/2001 | Yamaguchi | |
| 2001/0030864 | A1 | 10/2001 | Winkler et al. | |
| 2001/0038534 | A1 | 11/2001 | Galli | |
| 2002/0048174 | A1 | 4/2002 | Pederson | |
| 2002/0067608 | A1 | 6/2002 | Kruse et al. | |

FOREIGN PATENT DOCUMENTS

| | | |
|---|---|---|
| EP | 1108612 | 6/2001 |
| JP | 01243805 | 9/1989 |
| JP | 08130606 | 5/1996 |
| JP | 00090885 | 7/1999 |
| JP | 11175009 | 3/2000 |
| WO | WO0074972 | 12/2000 |
| WO | WO0113033 | 2/2001 |
| WO | WO0173860 | 10/2001 |
| WO | WO0214738 | 2/2002 |

OTHER PUBLICATIONS

Product Instructions for Bayco XPR-9850 & XLR-9850 Intrinsically Safe, Apr. 2007.

* cited by examiner 256
267
269
258
262
264
261
260
270
268
20
266
271
258
270'
272
274

290
294
296
284
286
298
276
301a
288
300
301b
292
282
280
302
278
304
301'
300'

INTRINSICALLY SAFE LIGHT

CROSS REFERENCE TO RELATED APPLICATIONS

This application is a continuation-in-part of prior U.S. patent application Ser. No. 10/863,104, filed Jun. 8, 2004, which is a continuation of U.S. patent application Ser. No. 10/119,555, filed Apr. 10, 2002, now U.S. Pat. No. 6,857,756, which is based on U.S. Provisional Application Ser. No. 60/283,002 filed Apr. 11, 2001.

This application hereby expressly incorporates by reference herein the entire disclosures of U.S. patent application Ser. No. 10/863,104, filed Jun. 8, 2004, and U.S. patent application Ser. No. 10/119,555, filed Apr. 10, 2002, now U.S. Pat. No. 6,857,756.

BACKGROUND OF THE INVENTION

The present invention relates to work lights used to illuminate task or work areas.

Conventionally, fluorescent or incandescent work lights are used to provide light in work areas. Such lights need to be relatively compact and portable. Work lights conventionally include a handle for gripping the light and a fluorescent or incandescent lamp for providing light to an area. The lamp may be at least partially covered by a transparent cover. The work light may include a cord and plug for connection to an electrical outlet. Alternatively, the work light may be battery operated.

Incandescent lamps have a thin filament which is energized to emit light when the work light is supplied with electrical current. A problem with work lights having incandescent lamps is that the filament in these light bulbs is fragile and may break relatively easily. The life of an incandescent bulb is determined by the length of time the filament stays intact as, once the filament breaks, the light bulb is no longer usable and must be replaced. A further problem with incandescent lamps is that they emit a substantial amount of heat. As batteries run down in incandescent work lights, the intensity of the light also tends to decrease.

Fluorescent work lights are preferred to those having incandescent light bulbs or lamps. Fluorescent lamps have a longer life than incandescent lamps. Fluorescent lamps do not have a fragile filament. Fluorescent lamps are constructed with a thin glass tube molded to a desired shape. Air is evacuated from the glass tube which is thereafter filled with a gas which forms a plasma in the presence of an electric field. Electrons from the plasma are absorbed by and excite a phosphor which coats the tube. The excited phosphor fluoresces or gives off visible light. Fluorescent lamps have a pair of leads at one or both ends which are inserted into a socket located in the handle or end cap of the work light. A problem with fluorescent lamps is that the glass of the tube may be thin and thus fragile. Other problems with fluorescent work lights are that the leads may tarnish or become loose in the socket, thereby breaking the electrical connection. Another problem with fluorescent work lights is that these types of lights require a relatively significant amount of voltage to operate. If battery operated, several batteries may be required to properly energize the lamp of the fluorescent work light making the work light heavy and cumbersome. Due to the amount of power required by the lights, the batteries must be replaced relatively often to maintain operation of the light.

LED lamps are well known and generally emit colored light such as red, green, or blue. When put together in a cluster, the light emitted appears as white light. LED lamps have conventionally not produced a sufficient amount of light so that they could be used in work lights and the like. However, recently LEDs which produce white light have been used in overhead reading lights on airplanes, in side view mirrors on vehicles, and in flashlights. These types of flashlights may be smaller such as a penlight which is about the size of an ink pen. An advantage of LEDs is that they have a long life.

It is desired to provide a work light which utilizes LED lamps as the source of light to provide a work light having a long life, requiring low power, and producing low heat while still supplying a bright light.

SUMMARY OF THE INVENTION

The present invention provides an improved work light which uses light-emitting diodes or LEDs as the light source for illuminating a work area.

The present invention provides a work light having clusters of LEDs. The types of LEDs utilized in these applications may be those which produce a white light. The cluster of LEDs may be powered by conventional power such as 120 to 240-volt AC power, a DC generator, a battery, or a battery pack source, for example. When powered by conventional 120 volt power, a tool tap or electrical outlet may be placed at the end of the handle of the work light to allow electrically operated tools to be plugged into the work light. A work light of the type in accordance with the present invention, but which does not use LEDs, is described in U.S. patent application Ser. No. 09/587,902 filed on Jun. 6, 2000, now U.S. Pat. No. 6,386,736 issued on May 14, 2002, and assigned to the assignee of the present invention. The disclosure of that application is hereby incorporated herein by reference.

In one form thereof, the present invention provides an intrinsically safe light including a base; a battery operably mounted in the base; a transparent cover operably associated with the base; an LED mounting member operably disposed adjacent the cover; a plurality of high intensity, low power consumption LEDs mounted on the mounting member and electrically connected to the battery. The intrinsically safe light further includes an optical adjustment structure including a base portion threadably engaged with the base; a lens fixedly attached to the base portion; and a resilient member biasing the lens from the base portion; whereby the threaded engagement between the base portion and the base permits the lens to be selectively displaced from the transparent cover.

One advantage of the present invention is that LEDs have a life which is much longer than the life of a fluorescent or incandescent lamp. Further, recently available LEDs require a relatively low amount of power while producing an amount of light comparable to incandescent lamps, while producing a low amount of heat.

BRIEF DESCRIPTION OF THE DRAWINGS

The above mentioned and other features and objects of this invention, and the manner of attaining them, will become more apparent and the invention itself will be better understood by reference to the following description of the embodiments of the invention taken in conjunction with the accompanying drawings, wherein.

Figure 1:
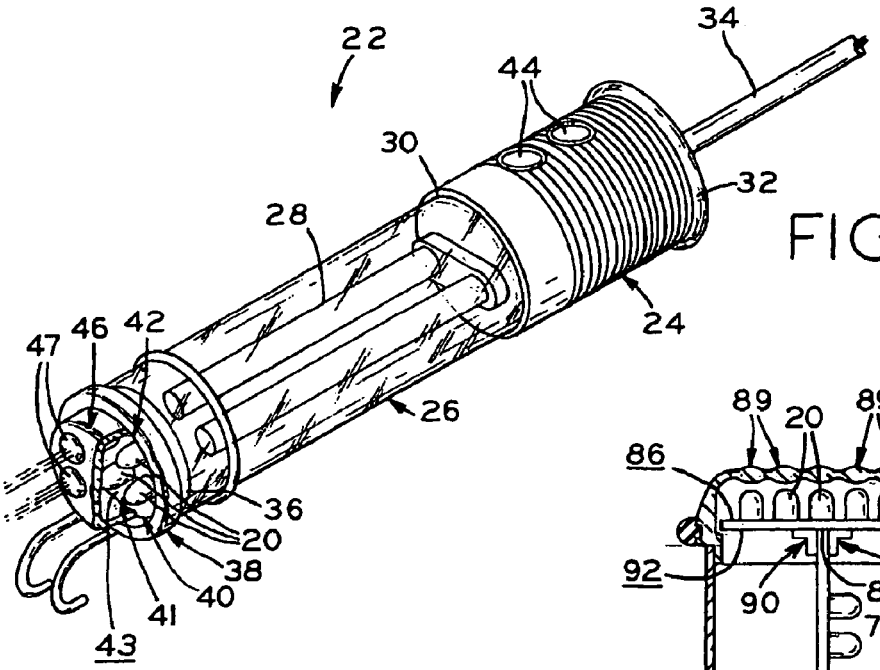
FIG. 1 is a perspective view of a work light in accordance with the present invention which uses both a fluorescent lamp and LEDs.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE INVENTION

Work lights such as those shown in FIGS. 1-38 are used to provide lighting in task or work areas. Such work lights are designed to be portable and very durable to endure repeated use as well as abuse such as from being dropped, for example. A handle is provided at one end of the work light. The work light has a generally transparent cover extending from the handle. The cover encases one or more light sources such as light emitting diodes or LEDs 20 illustrated in FIGS. 1-24 or focused LEDs 21 illustrated in FIGS. 25-38 in accordance with the present invention.

LEDs which emit white light are commonly available. However, prior to the availability of such white LEDs, LEDs including one red, one blue, and one green LED were sometimes clustered together to create approximately white light. LEDs which emit white light may be produced from any suitable material including phosphor compounds, gallium arsenide, or gallium nitride. LEDs may be purchased from several sources including LEDtronics, Inc., 4009 Pacific Coast Highway, Torrence, Calif.; Chicago Miniature Lamp, Inc., 147 Central Avenue, Hackensack, N.J.; Q.T. Optoelectronics, 610 North Mary Avenue, Sunnyvale, Calif.; Lumex Optocomponents, Inc., 292 East Hellen Road, Palatine, Ill.; and Gelcore, 6180 Halle Drive, Valley View, Ohio.

LEDs produce light, LEDs have a long life which may be from ten to twenty times the life of a fluorescent or incandescent lamp. LEDs have an outer shell in which a substance such as a phosphor compound, gallium nitride, or gallium arsenide is contained. When electrical current is supplied to LEDs, the substance is excited causing the emission of visible light. An additional type of LED is a focused LED in which an LED is mounted in a housing having a lens mounted thereto. The LEDs used in focused LEDs have greater light output than conventional LEDs. The lens has a convex portion located directly above the LED to intensify the light produced thereby. LEDs are rugged thus eliminating breakage problems. LEDs produce very little heat unlike fluorescent and incandescent lamps. Less power is required to illuminate LEDs thus making work lights using LEDs energy efficient. Due to the light weight of LEDs, the work lights are portable and of a significantly lower weight than conventional fluorescent and incandescent work lights.

The number of LEDs which are required for a work light is determined by the light output of the LEDs and by the task for which the work light is designed. Currently, white light LEDs generate approximately 12 lumens of light per watt of power. Soft incandescent lamps produce approximately 15 lumens of light per watt while fluorescent lamps produce approximately 63 lumens of light per watt. Therefore, in order to produce the same amount of light in a work area which is typically lit by a fluorescent lamp, approximately 5 LEDs would be required. The light output of LEDs used in focused LEDs is 18 lumens of light per watt of power. This is substantially greater than the light output of conventional LEDs. Focused LEDs can be purchased from Lumileds Co., 370 West Trimble Road, San Jose, Calif.

The embodiments of a work light using LEDs 20 in accordance with the present invention, which will be discussed hereinbelow, may be operated from a typical supply of 120 to 240-volt AC power, a DC generator, a battery, or a battery pack, for example. The work lights are also provided with a power regulator such as power regulator 104 shown in FIG. 4 which transforms input voltage from a power source into regulated operational voltage for LEDs 20 and the circuit board of which they are a part. The power regulator provides the voltage and current required by the work lights. When powered by conventional 120-volt power, an electrical cord extends from the work light having a plug at one end thereof for insertion into an electrical outlet. An advantage of having the work light which is operated from a 120 volt power supply is that a tool tap or electrical outlet may be provided in the work light to allow an electrically operated tool to be plugged into the outlet. In this case, the work light essentially operates as an extension cord as well as a light. When work lights are battery powered, an advantage is that they are self contained and portable.

Figure 24:
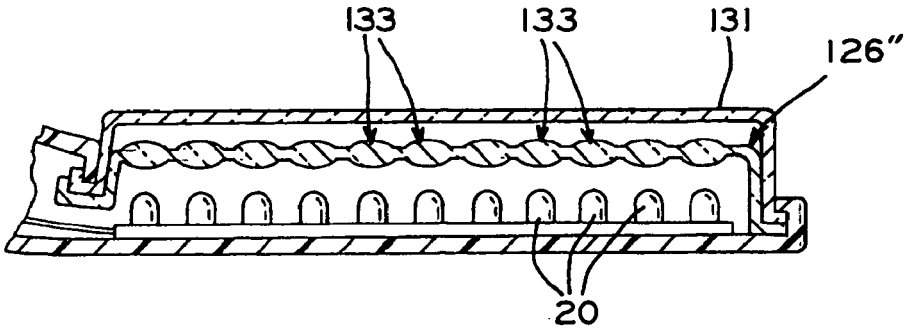
FIG. 24 is a fragmentary cross-sectional view of the work light of FIG. 6 showing a transparent protective cover.

Several types of covers may be provided to protect LEDs 20. One cover may include the convex lenses as illustrated in FIGS. 5, 7, 13, and 18 in which a plurality of dome shaped lenses are molded into the outside surface of the cover. Each lens is positioned directly above each LED 20. A second type of cover includes a pair of convex lenses or a double convex lens as shown in FIGS. 3, 6, 14, 17, and 24 in which a plurality of dome shaped lenses are molded into the outside and inner surfaces of the cover. Each associated pair of dome shaped lenses are aligned with one another, with both of the lenses being positioned directly over each LED 20. Alternatively, as shown in FIG. 24, the work light may be provided with a pair of covers. The first cover is an insert which includes a plurality of single or double convex lenses molded therein. The second, outer cover is smooth having no lenses formed therein. The second, outer cover is placed over the insert such that the insert is positioned between LEDs 20 and the second, outer cover. The insert may be provided with a plurality of cylindrical extensions molded into the inner surface of the insert in surrounding relation of each lens. The cylindrical extensions extend from the inner surface of the insert to provide means for aligning the insert with LEDs 20. The single and double convex lenses are provided to act as a magnifying glass to focus light emitted from each LED 20.

Figure 25:
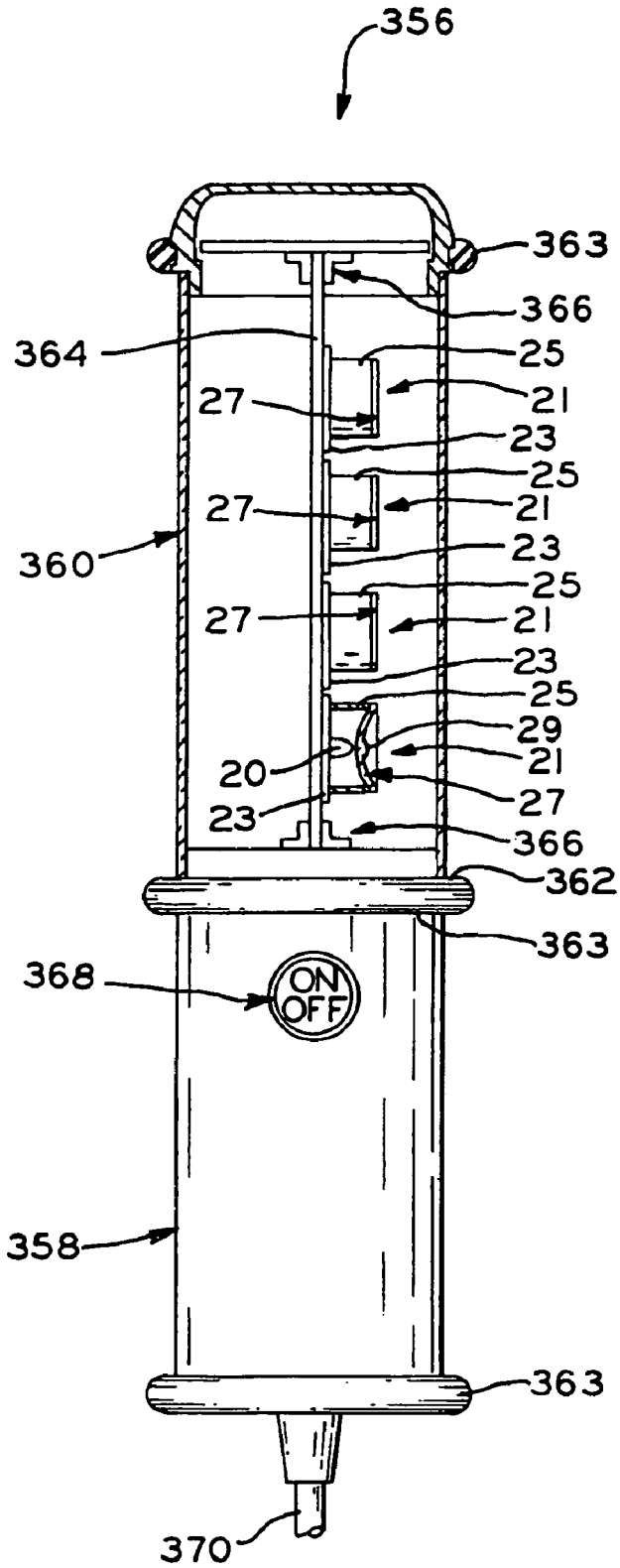
FIG. 25 is a side elevational view of a thirteenth embodiment of a work light using focused LEDs.

Referring to FIG. 25, focused LEDs 21 include base plate 23 to which cylindrical housing 25 is mounted with lens 27 secured to the open end of housing 25. Each focused LED 21 has one LED 20 mounted to base plate 23. Lens 27 is constructed from a transparent material such as plastic or glass and has integrally formed therein a single convex lens 29. Convex lens 29 in lens 27 is positioned above LED 20 to focus the light emitted from LED 20.

Referring to the specific embodiments of the work lights in accordance with the present invention, a work light 22 is shown in FIG. 1. Work light 22 includes handle 24 having secured to end 30 of handle 24 a transparent cover 26. Handle 24 and cover 26 may be constructed by any suitable means including injection molding or blow molding. The material from which handle 24 is constructed is generally plastic, however, any suitable material including metal may be used. Cover 26 may be constructed from any suitable material including glass or plastic. Positioned within cover 26 is fluorescent lamp 28 received in a socket located in end 30 of handle 24, positioning lamp 28 to be visible through cover 26 to light a work area. Extending outwardly from end 32 of handle 24 is power cord 34 which may be provided at its opposite end with an electrical plug or car adapter, for example. As mentioned above, power cord 34 may be replaced with a battery pack which would supply electrical current to work light 22. Cover 26 is tubular in shape and is closed at end 36 by housing 38. Housing 38 is secured to end 36 of cover 26 by welding or the like. Housing 38 is provided with hollow chamber 40 for receiving and encasing circuit board 41 having cluster 42 of LEDs 20 electrically mounted thereon. Each LED 20 has a pair of metal prongs or leads (not shown) extending from its base and which are received in apertures (not shown) located in circuit board 41. Solder is used to secure LEDs 20 to circuit board 41. LEDs 20 are mounted on surface 43 of circuit board 41. Alternatively, sockets may be provided on circuit board 41 into which the leads are plugged. The surface of circuit board 41 may be a reflective surface. In the disclosed embodiment, surface 43 is white. However, surface 43 may be any color suitable for reflecting light emitted from LEDs 20 while providing an aesthetically pleasing appearance. Circuit board 41 may be secured within housing 38 by any suitable means including providing a groove in housing 38 into which circuit board 41 is snap fit. Housing 38 includes transparent cover 46 through which LEDs 20 are visible. Cover 46 is secured to housing 38 by any suitable method such as being integrally formed or soldered. Cover 46 includes convex lenses 47 molded therein with one lens 47 being located over each LED 20. A portion of cover 46 shown in FIG. 1 is broken away for illustration purposes. Lenses 47 are dome shaped and are provided on the outer surface of cover 46 to magnify and focus light emitted from each LED 20. It is understood that work light 22 may be provided with any of the types of covers discussed above.

In the embodiment of FIG. 1, cluster 42 includes four LEDs 20 for providing light at the end of work light 22, thereby allowing work light 22 to function as a conventional flashlight. Work light 22 may also function as a typical fluorescent work light wherein lamp 28 is energized. Further, both fluorescent lamp 28 and LEDs 20 may be energized to provide additional light to the work area. Each source of light, fluorescent lamp 28 and LEDs 20, are independently operable by a pair of switches 44 located in handle 24. Even though only four LEDs 20 are shown in cluster 42, it is understood that any number of LEDs 20 may be used to emit a sufficient amount of light therefrom. Additionally, LEDs 20 may be replaced by focused LEDs 21 as described hereinbelow.

Figure 2:
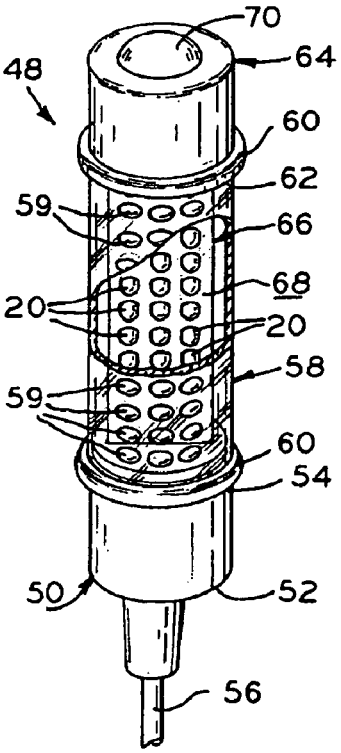
FIG. 2 is a side elevational view of another embodiment of the work light in accordance with the present invention having a circuit board with a plurality of LEDs mounted thereon.

Referring to FIG. 2, a second embodiment of a work light in accordance with the present invention is shown. Work light 48 includes handle 50 having ends 52 and 54 with power cord 56 extending from end 52. Secured to end 54 of handle 50 is transparent cover 58. A portion of cover 58 shown in FIG. 2 is broken away for illustration purposes. Handle 50 and cover 58 may be constructed by any suitable method such as injection molding or blow molding. As with handle 24 and cover 26 of work light 22, handle 50 may be formed from any suitable material including plastic or metal. The material used for cover 26 may also be any suitable material including plastic or glass. Disposed at both ends of cover 58 are rubber bumpers 60 which are designed to protect work light 48 from damage if the light were dropped, for example. Cover 58 is provided with a plurality of transparent dome shaped or convex lenses 59. One lens 59 is located directly above each LED 20 to magnify and focus the light emitted therefrom. Lens 59 is illustrated as being a single convex lens molded into the outer surface of cover 58, however, any of the types of covers discussed above may be utilized. Disposed at end 62 of cover 58, furthest from handle 50, is dome 64 which may be constructed from any suitable material. Positioned within cover 58 is circuit board 66 which has a plurality of LEDs 20 mounted thereon in the same manner as described above. Circuit board 66 is mounted vertically between handle 50 and dome 64 such that LEDs 20 are disposed along the longitudinal axis of work light 48. One end of circuit board 66 is electrically connected to handle 50. Surface 68 of circuit board 66 may be white rather than a conventional green or brown. Surface 68, however, may be any color which provides an aesthetically pleasing reflective surface for light emitted from LEDs 20. Switch 70 is disposed at end 62 of work light 48 centered within dome 64 to operate LEDs 20 of work light 48.

Figure 3:
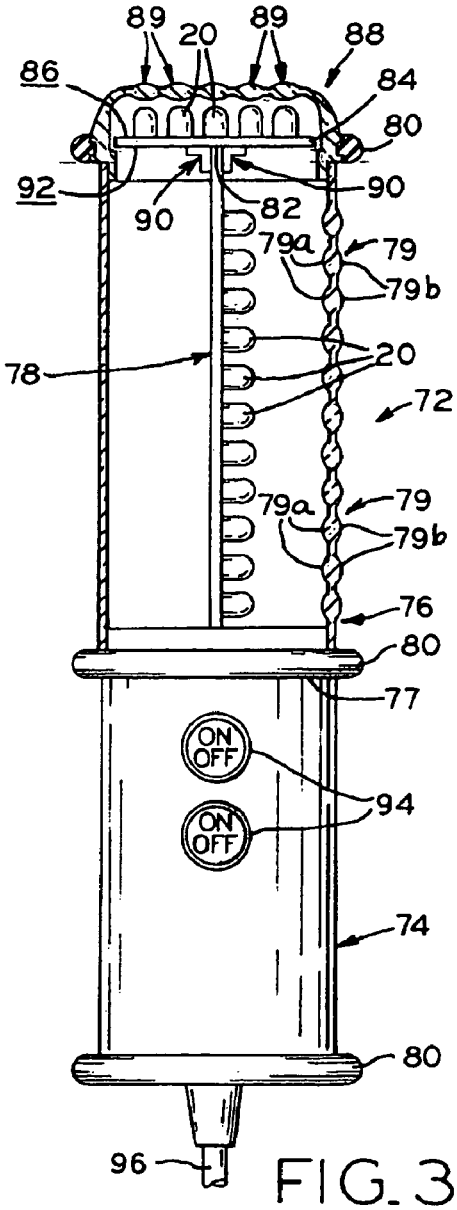
FIG. 3 is a side elevational view of a work light similar to the work light of FIG. 2 but including a second circuit board on which LEDs are mounted, and positioned perpendicularly to the first circuit board.

An alternative work light design is shown in FIG. 3. Work light 72 is provided with handle 74 having transparent cover 76 secured to end 77 thereof. Handle 74 and cover 76 may be constructed in a similar manner to handle 50 and cover 58 of work light 48 as described above. Cover 76 is illustrated in FIG. 3 as having a plurality of double convex lenses 79. Dome shaped lenses 79*a* and 79*b* respectively protrude from the inner and outer surfaces of cover 76. Lenses 79*a* and 79*b* are aligned with one another as well as with LED 20. Although cover 76 is shown as having double convex lenses, cover 76 may be of any type discussed previously. Work light 72 further includes vertically disposed circuit board 78 having LEDs 20 mounted on one side thereof. Circuit board 78 is positioned in cover 76 in the same manner as circuit board 66. Rubber bumpers 80 are disposed at either end of handle 74 as well as the top end of cover 76 to protect work light 72 from damage. Disposed perpendicularly to end 82 of circuit board 78 is second circuit board 84. Circuit board 84 also has a surface 86 which may be white for the reasons discussed above. A plurality of LEDs 20 are electrically mounted on circuit board 84. In this embodiment, dome shaped cover 88 is secured to end 93 of cover 76 by any suitable method. Cover 88 is transparent, allowing LEDs 20 on circuit board 84 to provide illumination similar to that of a flashlight. Cover 88 is illustrated as having double convex lens 89 positioned over each LED 20, however, cover 88 may be of any type previously described. A pair of L-shaped brackets 90 are secured to lower surface 92 of circuit board 84. A space is defined between brackets 90 to received end 82 of circuit board 78, linking the pair of circuit boards. Switches 94 are disposed in handle 74 to independently supply current to each circuit board 78 and 84 and thus LEDs 20. Work light 72 is shown having power cord 96 extending from one end of handle 74, however, it is understood that alternative methods of providing electrical power to work light 72 may be used.

Figure 4:
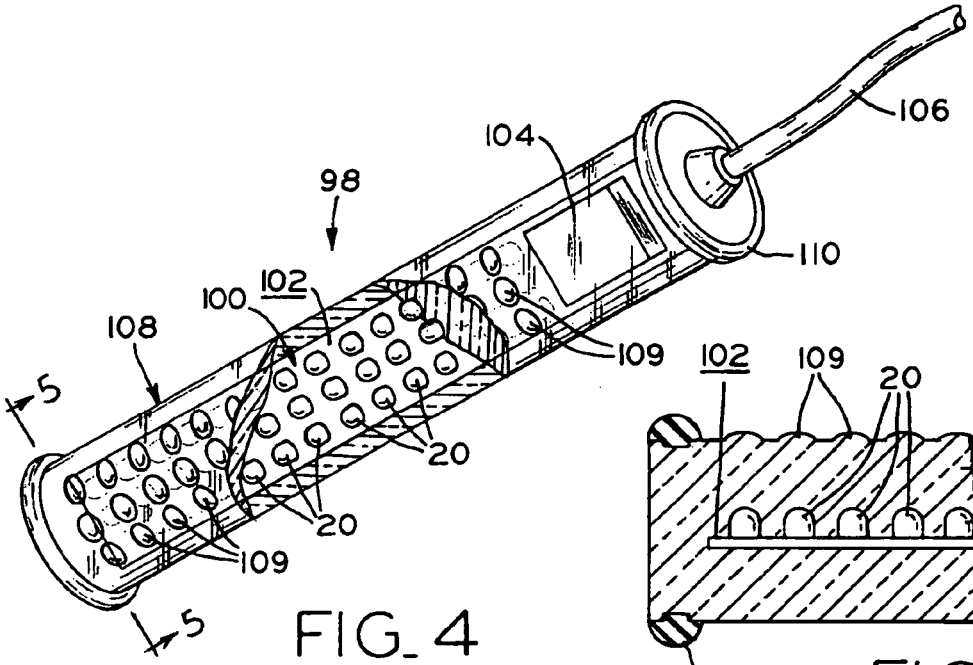
FIG. 4 is a perspective view of a third embodiment of a work light in accordance with the present invention.
Figure 5:
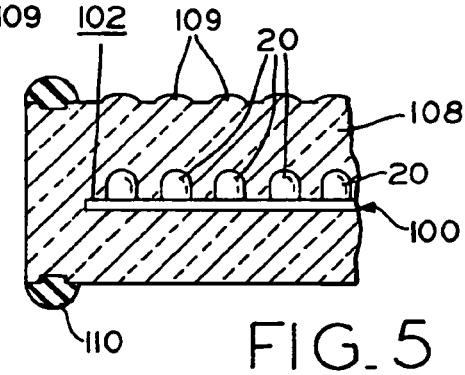
FIG. 5 is a partial, cross-sectional view of the work light of FIG. 4 taken along line 5-5.

FIGS. 4 and 5 disclose a third embodiment of a work light in accordance with the present invention. Submersible work light 98 includes circuit board 100 having a plurality of LEDs 20 mounted on surface 102 thereof in the same manner as discussed above. Power regulator 104 is disposed at one end of circuit board 100 to transform the input voltage from the power source into the appropriate operating voltage for LEDs 20 and circuit board 100 of which they are a part. In this embodiment, the input power is 120 volts from an electrical outlet through power cord 106. Solid, transparent casing 108 is molded around circuit board 100, LEDs 20, power regulator 104, and the end of cord 106. Rubber bumpers 110 are secured to each end of casing 108 to protect work light 98 from damage. Casing 108 is molded about circuit board 100, LEDs 20, power regulator 104, and the end of cord 106 to allow work light 98 to be submersible or waterproof. The material used to encase the components of work light 98 may be of any suitable material such as epoxy or the like which provides a waterproof light. A portion of casing 108 shown in FIG. 4 is cut away for illustration purposes. Molded into the casing 108 are a plurality of convex or dome shaped lenses 109. Each lens 109 is located directly above each LED 20 to magnify and focus light emitted from LEDs 20. In this embodiment, work light 98 is provided with a plurality of single convex lenses due to casing 108 being solid. Work light 98 may be used in a CNC machine, underwater diving, or other applications requiring a sealed, waterproof light fixture. As discussed above, cord 106 may be replaced by a removable battery pack to allow work light 98 to be portable.

Figure 6:
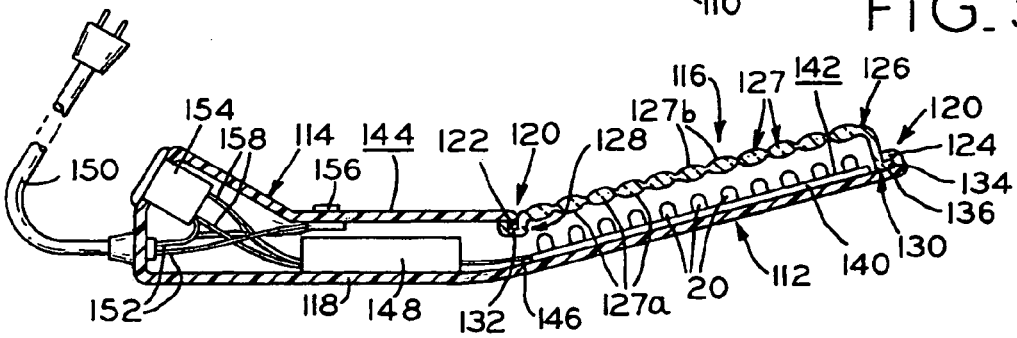
FIG. 6 is a cross-sectional view of a fourth embodiment of a work light in accordance with the present invention wherein the work light includes a power cord.
Figure 7:
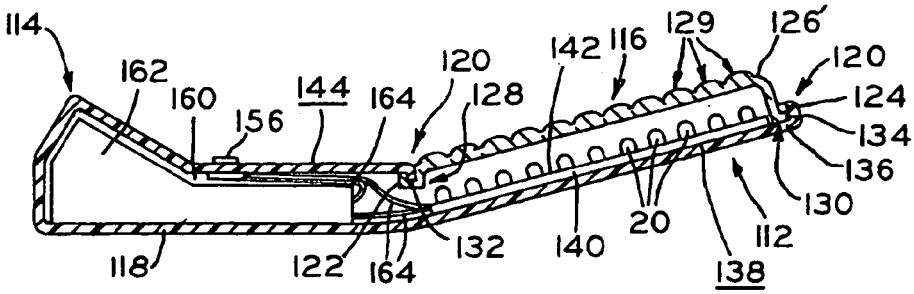
FIG. 7 shows the work light of FIG. 6 wherein the work light is battery operated.

A fourth embodiment of a work light in accordance with the present invention is illustrated in FIGS. 6 and 7. Work light 112 includes handle portion 114 and light head portion 116 which is disposed at a slight angle relative to handle portion 114. Work light 112 is constructed such that casing 118 completely surrounds handle portion 114 and extends along the backside of light head portion 116. Casing 118 may be constructed from any suitable material including plastic or metal by any suitable method such as molding. Terminating ends 120 of casing 118 are molded to define hook-like projections 122 and 124. Transparent cover 126 is positioned over circuit board 140 carrying LEDs 20 and has ends 128 and 130. Cover 126 may be plastic, glass, or the like which is formed by any suitable method. End 128 is C-shaped such that hook-like projection 122 fits into space 132 formed by the C-shaped end. End 130 is L-shaped such that leg 134 of end 130 engages space 136 of hook-like projection 124. The connections between ends 128 and 130 and hook-like projections 122 and 124 secure cover 126 to casing 118, over LEDs 20.

Cover 126 may be provided with either double or single convex lenses as respectively illustrated in FIGS. 6 and 7. Referring to FIG. 6, cover 126 is provided with a plurality of double convex lenses 127. Dome shaped lenses 127*a* and 127*b* respectively protrude from the inner and outer surfaces of cover 126. Lenses 127*a* and 127*b* are aligned with one another as well as with LED 20 to magnify and focus light emitted from each LED 20. Referring to FIG. 7, cover 126' is provided with a plurality of single convex lenses 129 in which one dome shaped lens 129 protrudes from the outside surface of cover 126'. Each lens 129 is disposed directly over one LED 20 to magnify and focus light emitted therefrom. Work light 112 may be provided with a third type of cover illustrated in FIG. 24. This type of lens includes cover or insert 126" similar to covers 126 and 126' having a plurality of single or double convex lenses 133 molded therein. In this embodiment, a second cover 131 is placed over insert 126" such that insert 126" is situated between LEDs 20 and cover 131.

Mounted to inner surface 138 of casing 118 is circuit board 140 which has surface 142. Surface 142 of circuit board 140 is white, however, surface 142 may be any color which provides an aesthetically pleasing reflective surface. LEDs 20 are mounted on circuit board 140 by soldering. The angle between clear cover 126 and upper surface 144 of handle portion 114 is at an angle less than 180 degrees. The slightly angled design provides better directional control of the light from light head portion 116. One end of circuit board 140 is electrically connected via wires 146 to power regulator 148 which converts input power from the electrical source into power suitable to energize LEDs 20. Referring to FIG. 6, work light 112 is shown being operable by electrical power cord 150 which is electrically wired via wires 152 to tool tap 154 and switch 156. Tool tap 154 is electrically connected to power regulator 148 via wires 158. Referring to the alternative embodiment shown in FIG. 7, internal cavity 160 of handle portion 114 is of a size suitable to receive battery pack 162, making work light 112 portable. In this case, battery pack 162 is electrically linked to circuit board 140 as well as switch 156 via wires 164. Switch 156 is also electrically linked to circuit board 140 via wire 164.

Figure 8:
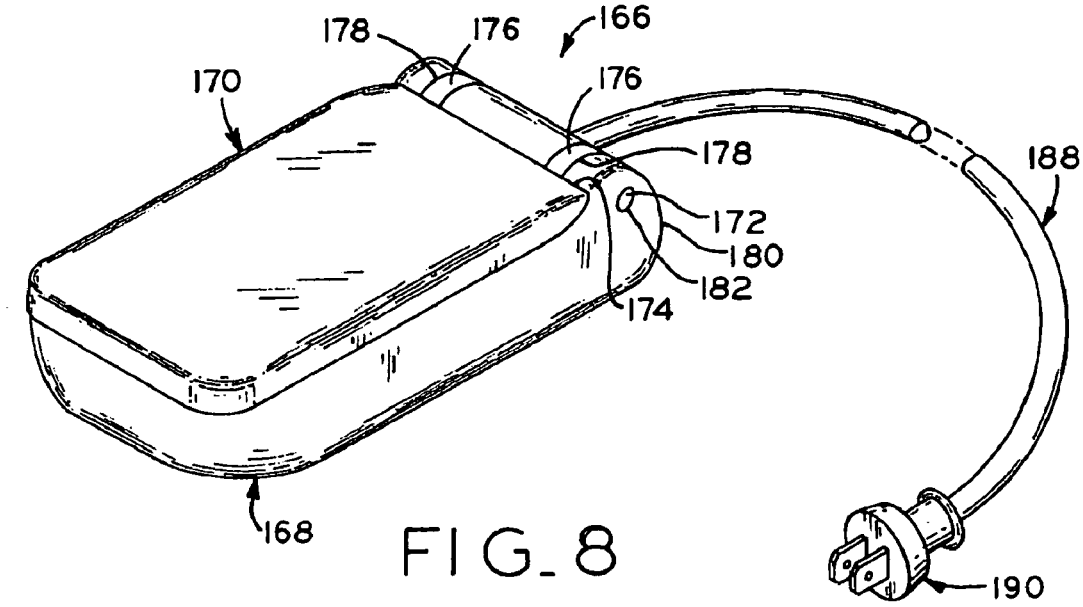
FIG. 8 is a perspective view of a fifth embodiment of a work light in accordance with the present invention having a cover which is shown in a closed position.
Figure 9:
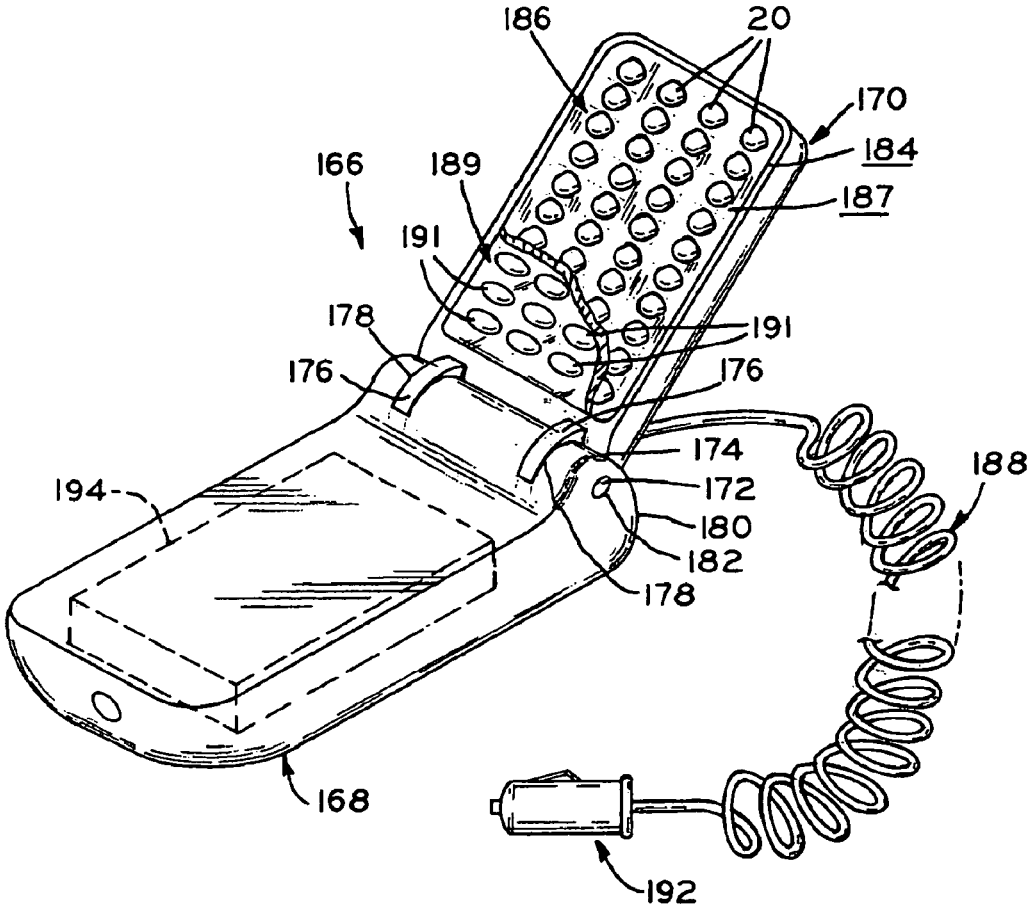
FIG. 9 is a perspective view of the work light of FIG. 8 showing the work light with the cover in the open position.

Referring to FIGS. 8 and 9, a fifth embodiment of a work light in accordance with the present invention is illustrated. Work light 166 includes base portion 168 and cover or light head portion 170 which are hinged to one another via hinge pin 172. Base portion 168 and light head portion 170 may be formed using any suitable method such as injection molding. Any suitable material such as plastic or metal may be used to construct portions 168 and 170. Located along lower edge 174 of light head portion 170 are a pair of links 176 having an aperture therethrough (not shown). Links 176 are received in cutouts 178 located along edge 180 of base portion 168. Aperture 182 extends the length of edge 180 wherein the aperture in links 176 aligns with aperture 182 to accommodate hinge pin 172. Mounted to inner surface 184 of light head portion 170 is circuit board 186 having surface 187 on which LEDs 20 are mounted (FIG. 9). Surface 187 is white, however, surface 187 may be any color which is reflective and aesthetically pleasing. Transparent cover 189 may be secured in light head portion 170 by any suitable means to cover and protect LEDs 20 and circuit board 186. A portion of cover 189 is broken away in FIG. 9 for illustration purposes. Cover 189 is provided with a plurality of lenses 191 molded therein, each of which is located directly above one LED 20 to magnify and focus light emitted therefrom. Lenses 191 are illustrated in FIG. 9 as being dome shaped or convex lenses located on the outer surface of cover 189. It is understood that work light 166 may be provided with any of the types of covers discussed above.

The hinge portion of work light 166 is ratcheted so that light head portion 170 may be opened relative to base portion 168 in increments from a closed position to being fully opened. A switch (not shown) is built into the hinge such that, when lid portion 70 is opened to a first increment, LEDs 20 are energized. Work light 166 is approximately the same size as a cellular phone which fits easily in a pant pocket, shirt pocket, or belt carrier for example. However, light 166 may be sized larger or smaller depending on the application or task for which the light is intended.

Power cord 188 extends from the hinged point between base portion 168 and light head portion 170. Referring to FIG. 8, power cord 188 has conventional plug 190 attached thereto for being received within a conventional 120 volt electrical outlet. Work light 166 illustrated in FIG. 9 is provided with car adapter plug 192 which permits recharging of rechargeable battery 194. Work light 166 may also be battery operated as has been discussed above.

Figures 10, 11, 12, 13, 14:
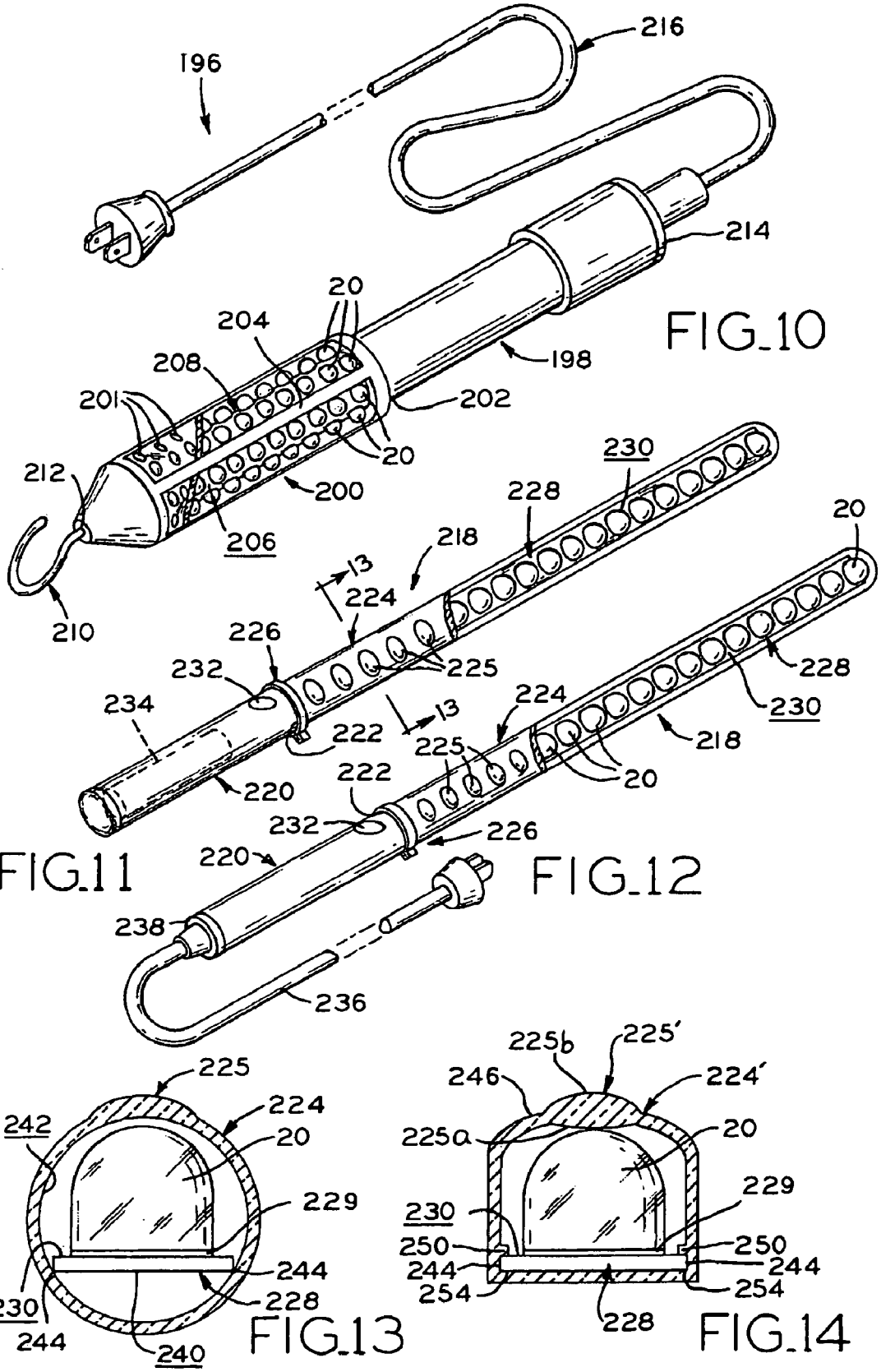
FIG. 10 is a perspective view of a sixth embodiment of a work light in accordance with the present invention.
FIG. 11 is a perspective view of a seventh embodiment of a work light in accordance with the present invention wherein the work light is battery operated.
FIG. 12 shows the work light of FIG. 11 wherein the work light includes a power cord.
FIG. 13 is a cross-sectional view of the work light of FIG. 11.
FIG. 14 is a cross-sectional view of the work light of FIG. 11 showing an alternative shape for the cover of the light.

FIG. 10 shows a sixth embodiment in accordance with the present invention. Work light 196 is an explosion proof light which includes handle 198 with globe 200 secured to end 202 of handle 198. Surrounding globe 200 is guard 204 which provides a bumper guard for protection of globe 200. Globe 200 is provided with a plurality of lenses 201 molded into the surface thereof. A portion of globe 200 shown in FIG. 10 is broken away for illustration purposes. Lenses 201 are each located in alignment with one LED 20 to magnify and focus light emitted from LEDs 20. Although lenses 201 are shown on the outer surface of globe 200, it is understood that work light 196 may be provided with any of the types of covers discussed above. Handle 198, globe 200, and guard 204 are constructed from phenolic material, tempered glass, and aluminum, however, may be any suitable material to make work light 196 explosion proof. A phenolic material possesses characteristics such as superior strength and heat resistance in comparison to other thermoplastic materials. LEDs 20 are retrofit into work light 196, replacing a fluorescent or incandescent lamp. LEDs 20 are clustered and are mounted to surface 206 of circuit board 208 in the same manner as discussed above. Surface 206 may be white for the same reasons discussed above. Circuit board 208 is cylindrically shaped so that LEDs 20 may be visible about the perimeter of globe 200. Hook 210 is secured to end 212 of guard 204 to allow work light 196 to be hung in a work area, thereby freeing the hands of the user. Secured to end 214 of handle 198 is power cord 216 which provides a path for electrical current to travel to work light 196. Alternatively, a battery pack may be used in place of power cord 216 to make work light 196 portable. Work light 196 is explosion proof which means that the light will not cause an explosion in the atmosphere in which it is being used by containing any sparks within the light head. Work light 196 is similar to those currently offered with fluorescent or incandescent lamps. Applications or task areas where an explosion proof work light may be desirable include refineries, granaries, fuel storage areas, sewers, chemical plants, or other confined areas where hazardous vapors are present.

FIGS. 11 and 12 show a seventh embodiment in accordance with the present invention. Work light 218 is a thin or "skinny" light which may be used in small or tight work areas. Work light 218 includes handle 220 having end 222 to which transparent cover 224 is attached via ring clamp 226. Handle 220 and cover 224 may be constructed from any suitable method including injection molding or blow molding. Materials such as metal or plastic may be used to construct handle 220. Cover 224 may be formed from plastic, glass, or the like. A portion of cover 224 is broken away in FIGS. 11 and 12 for illustration purposes. Cover 224 is provided with a plurality of lenses 225, each of which are located directly above one LED 20 to magnify and focus light emitted therefrom. As discussed above, cover 224 may be one of any of the types of covers previously described. Ring clamp 226 also functions to attach to a clamp or magnet to hold work light 218 in a desired position in a work area, thereby freeing the hands of the user. Secured within cover 224 in a manner which will be discussed hereinbelow is circuit board 228. A single row of LEDs 20 are mounted on surface 230 of circuit board 228. Surface 230 is white. However, any suitable color may be used to provide an aesthetically pleasing reflective surface. Fluorescent or incandescent lamps could similarly be used in a light such as work light 218. However, due to the size of work light 218, LEDs 20 produce a significantly greater light output than a fluorescent or incandescent lamp. Located on handle 220 is switch 232 which operates work light 218. In the embodiment shown in FIG. 11, battery 234 is disposed within handle 220 to allow work light 218 to be portable. In the embodiment shown in FIG. 12, power cord 236 is secured to end 238 of handle 220 allowing work light 218 to be plugged into a conventional 120 volt outlet.

Referring to FIGS. 13 and 14, a cross-sectional view through cover 224 of work light 218 is illustrated. As shown in FIG. 13, cover 224 is cylindrical with a circular cross-section. Edges 244 of lower surface 240 of circuit board 228 engage two points along inner surface 242 of cover 224 to secure circuit board 228 within cover 224. LED 20 is illustrated as having base portion 229 which is mounted in abutting relationship with surface 230 of circuit board 228. Cover 224 is illustrated as having a single convex or dome shaped lens 225 molded therein and positioned directly above each LED 20. Referring to FIG. 14, cover 224' is shown as being substantially rectangular with rounded top portion 246. Projections 250 are provided on inner surface 248 of cover 224'. Projections 250 define with the inner surface of lower portion 252 of cover 224', spaces 254 for receiving edges 244 of circuit board 228 to mount circuit board 228 in cover 224'. Rounded top portion 246 is sized to encompass LEDs 20 while being aesthetically pleasing. Covers 224' is shown as having double convex or dome shaped lens 225' molded therein. Lens 225' includes dome shaped portions 225*a*' and 225*b*' respectively protruding from the inner and outer surfaces of cover 224'. Although covers 224 and 224' are illustrated as having single convex lens 225 and double convex lens 225', it is understood that work light 218 may be provided with any of the types of covers discussed above.

Figures 15, 16, 17, 18:
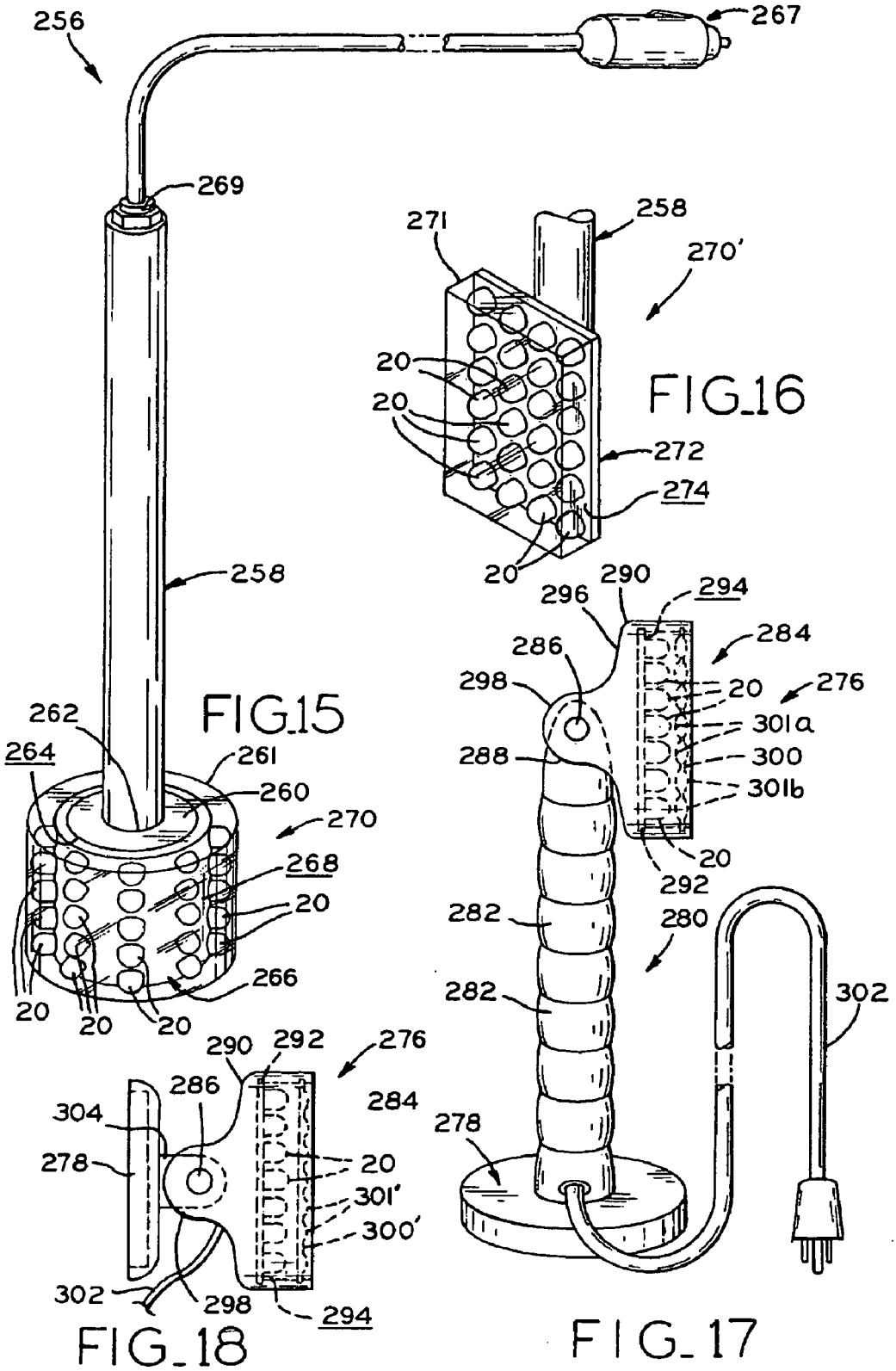
FIG. 15 is a perspective view of an eighth embodiment of a work light in accordance with the present invention.
FIG. 16 is a fragmentary perspective view of the work light of FIG. 15 showing an alternative light head.
FIG. 17 is a perspective view of a ninth embodiment of a work light in accordance with the present invention.
FIG. 18 is a side elevational view of the work light of FIG. 17 wherein the light head is mounted directly to the base.

Referring to FIG. 15, shows an eighth embodiment in accordance with the present invention. Work light 256 includes elongated handle 258 having solid cylindrical support 260 secured to end 262 of handle 258. Handle 258 may be constructed from any suitable material including plastic or metal. Cylindrical support 260 is of a diameter slightly larger to that of handle 258. Secured to outer surface 264 of cylindrical support 260 is circuit board 266 having surface 268 to which LEDs 20 are mounted. As with previous embodiments, surface 264 is white, however, may be any color suitable for providing an aesthetically pleasing reflective surface. Circuit board 266 may be secured to cylindrical support 260 by any suitable means including being epoxied or using fasteners. Mounted to cylindrical support 260 is transparent cover 261 which may be constructed from a material such as plastic or glass by any suitable method. Work light 256 may be used to inspect barrels such as large gallon drums which must be visually inspected for rust, leaks, or material still remaining in the barrel. Light head 270 which incorporates circuit board 266, cylindrical support 260 and LEDs 20, is small enough so that it can be inserted through the bung hole of the barrel. Handle 258 of light 256 is of a sufficient length so that light head 270 may reach far enough into the barrel to illuminate the inside of the barrel, thereby allowing for inspecting of the barrel. Work light 256 may be used in several other applications having confined areas and small openings such as tanks or shipping containers, for example. The embodiment of work light 256 shown in FIG. 15 is provided with car adapter 267 which is secured to end 269 of handle 258, however, any suitable power source as discussed above may be used to supply power to work light 256.

FIG. 16 shows an alternative design of light head 270. Light head 270' includes flat circuit board 272 having LEDs 20 mounted on surface 274 thereof. Light head 270' is mounted directly to the end of handle 258 by any suitable means. Mounted to circuit board 272 is transparent cover 271 which may be constructed from a material such as plastic or glass by any suitable method. As with surface 264 of light head 270, surface 274 of light head 270' may be white to provide an aesthetically pleasing reflective surface. LEDs 20 are mounted to one surface of circuit board 272 requiring rotation of light head 270' to inspect the entire interior of a barrel. However, with a flat circuit board, a higher intensity light is produced by the cluster of LEDs which provides a brighter light when inspecting the barrel.

FIG. 17 shows the ninth embodiment in accordance with the present invention. Work light 276 includes base 278 atop which is flexible neck 280. Base 278 may be magnetic to allow work light 276 to be mounted to any metal surface. Neck 280 is constructed from a plurality of separate beads or segments 282 which are linked together. Flexible neck 280 may be positioned to any of a plurality of locations to provide sufficient light to the work area. Neck 280 may be constructed from other flexible materials such as a spiral wound metal having a plastic cover. Segments 282 may be added or removed to increase or decrease the length of neck 280 depending on the application and work area in which light 276 is being used. Light head 284 is pivotally mounted to end segment 288 of flexible neck 280 by pin 286. Extending from rear surface 296 of light head housing 290 is flange portion 298 having an aperture therein which aligns with an aperture located in end segment 288. Pin 286 is placed through the aligning apertured to mount light head 284 to neck 280. Housing 290 is circular and supports circuit board 292 having surface 294 with LEDs 20 mounted thereon. Surface 294 is white, however, may be any color which provides an aesthetically pleasing reflective surface. Circuit board 292 is cut to have substantially the same shape as housing 290. Circuit board 292 is secured within housing 290 by any suitable means including a groove provided in the inner surface of housing 290 into which the edges of circuit board 292 are snap fit. A chip resistant glass cover 300 is fastened within housing 290, covering LEDs 20 to protect the LEDs of work light 276 from damage if dropped, for example. Cover 300 is illustrated in FIG. 17 as being provided with a plurality of double convex or dome shaped lenses 301. Double convex lenses 301 include domes 301*a* and 301*b* which respectively protrude from the inner and outer surfaces of cover 300. Each lens 301 is located directly above one LED 20 to magnify and focus light emitted from each LED 20. An alternative method of protecting LEDs 20 is to pot the lights in a clear epoxy wherein the cluster of LEDs 20 would be completely surrounded in epoxy. With LEDs 20 potted in an epoxy material, single convex or dome shaped lenses would be molded into the outer surface of the epoxy, each lens located directly above each LED. An on/off switch (not shown) is positioned under a moisture tight cover at the point of pivotal connection between light head 284 and flexible neck 290. Light head 284 of work light 276 is moisture tight to allow light 276 to be used in work areas where the light may be subject to splashing of hydraulic or coolant type fluid. Power cord 302 extends from the lower most segment 282 providing means for electrical current to light head 284.

Referring to work light 276 shown in FIG. 18, light head 284 is directly mounted to protrusion 304 extending from base 278 allowing work light 276 to be mounted to a wall, for example. Cover 300' illustrated in FIG. 18 is provided with single convex or dome shaped lenses 301'. Lenses 301' protrude from the outer surface of cover 300', with each lens in alignment with each LED 20. Although covers 300 and 300' are illustrated as having double and single convex lenses, respectively, it is understood that work light 276 may be provided with any of the types of covers discussed previously.

Figure 19:
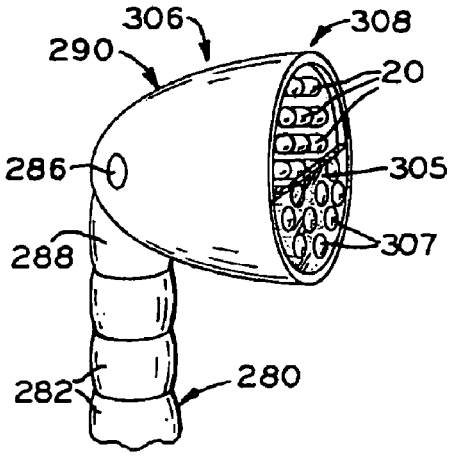
FIG. 19 is a fragmentary perspective view of the tenth embodiment of a work light in accordance with the present invention.
Figure 20:
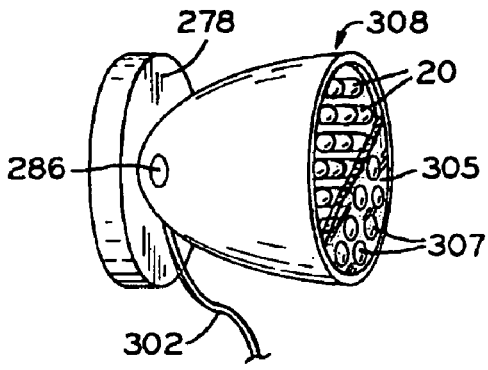
FIG. 20 is a side elevational view of the work light of FIG. 19 wherein the light head is mounted directly to a base.

FIGS. 19 and 20 show a tenth embodiment of a work light in accordance with the present invention and is similar to work light 276. Work light 306 includes light head 308 which is different in shape than light head 284. Light head 308 is cone-shaped. Light head 308 may be mounted to flexible neck 280 as shown in FIG. 19 or may be alternatively mounted directly to base 278 as shown in FIG. 20. Cover 305 of work light 306 is similar to covers 300 and 300' of work light 276 and may be provided with any type of cover as discussed above with regards to work light 276. A portion of cover 305 is broken away in FIGS. 19 and 20 for illustration purposes. The applications of work light 306 are similar to those of work light 276 with the difference being the size of the light head.

Figure 21:
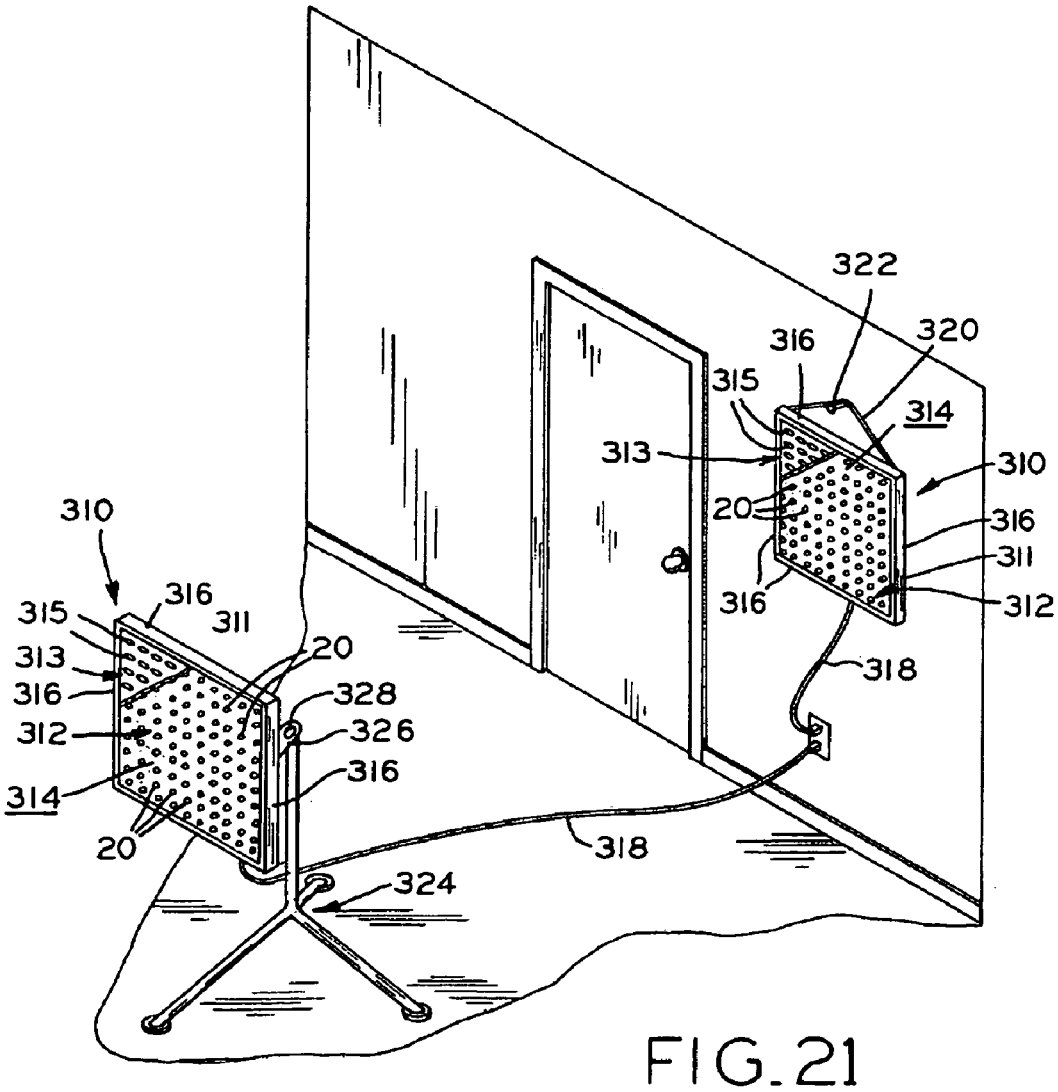
FIG. 21 is a perspective view of the eleventh embodiment of a work light in accordance with the present invention.

FIG. 21 shows an eleventh embodiment of a work light in accordance with the present invention. Work light 310 includes flat panel 311 which supports circuit board 312 having LEDs 20 mounted thereon. LEDs 20 are mounted to surface 314 of circuit board 312. Surface 314 may be white for the same reasons discussed above. Circuit board 312 is framed by framing legs 316 which are similar to that of a picture frame. Power cord 318 extends from behind circuit board 312 to provide electrical current to work light 310. Work light 310 may be mounted to a wall wherein mounting wire 320 is hung over nail 322 as is shown in FIG. 21. Work light 310 may alternatively be mounted on stand 324. Located at the top end of stand 324 is bracket 326 which is pivotally mounted at 328 to stand 324 to allow movement of work lights 310 up or down with respect to stand 324. Work light 310 may be provided with cover 313 having a plurality of lenses 315 molded therein. Cover 313 is broken away in FIG. 21 for illustration purposes. Each lens 315 is located in line with one LED 20 to magnify and focus light emitted from LEDs 20. Work light 310 may be provided with any of the types of covers discussed previously. Work light 310 is applicable to work areas such are garages and storage areas.

Figure 22:
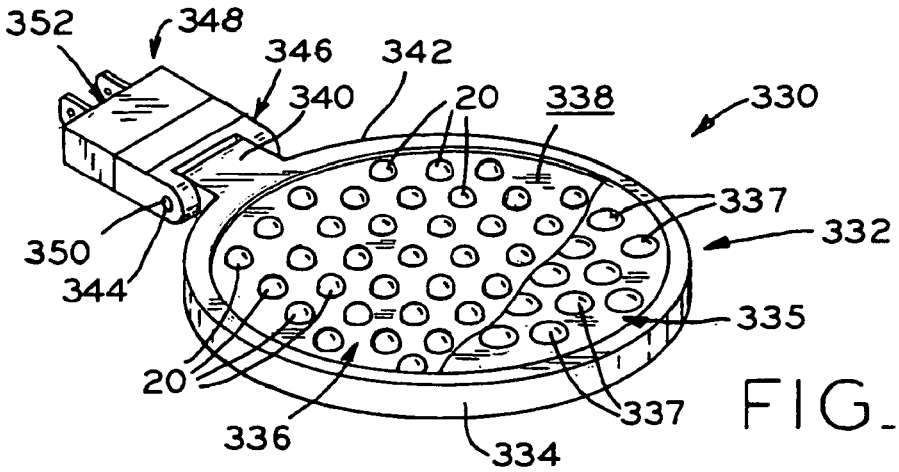
FIG. 22 is a perspective view of a twelfth embodiment of a work light in accordance with the present invention wherein the work light is received in a plug-in outlet.
Figure 23:
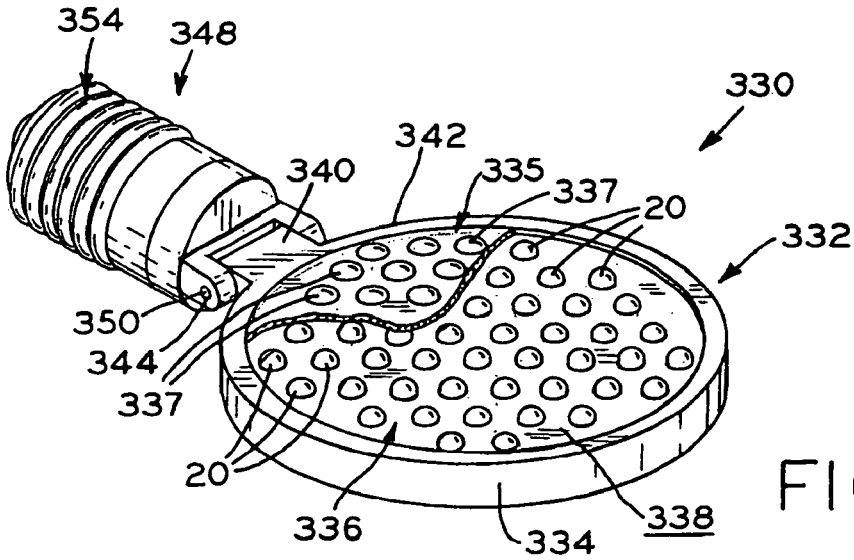
FIG. 23 is a perspective view of the work light of FIG. 22 wherein the work light is received in a threaded lamp base.

FIGS. 22 and 23 show a twelfth embodiment of a work light in accordance with the present invention. Work light 330 includes light head 332 having support frame 334 with circuit board 336 mounted within frame 334. Also mounted to support frame 334 is cover 335 having a plurality of lenses 337 molded in one or both surfaces thereof. Cover 335 is broken away in FIGS. 22 and 23 for illustration purposes. One lens 337 is located directly above each LED 20 to magnify and focus the light being emitted from the LEDs. It is understood that work light 330 may be provided with any of the types of covers described above. Circuit board 336 has surface 338 on which LEDs 20 are mounted. Surface 338 is white to provide an aesthetically pleasing reflective surface, however, surface 338 may be any suitable color. Tab 340 extends radially from outer perimeter 342 of frame 334. Tab 340 is provided with an aperture (not shown) therethrough which aligns with apertures 344 in bracket 346 of electrical connection means 348. Pin 350 extends through the aligned apertures to pivotally mount light head 332 to electrical connection means 348. Referring to FIG. 22, electrical connection means 348 is illustrated as electrical plug 352 which would plug into any conventional 120 volt electrical outlet located in a wall or extension cord, for example. As illustrated in FIG. 23, electrical connection means 348 is shown as threaded cap 354 similar to one which would be located at the end of an incandescent or fluorescent lamp. The embodiment shown in FIG. 23 would be mounted in a light socket of a ceiling light or table lamp, for example. Work lights 330 illustrated in FIGS. 22 and 23 may be used as temporary indoor or outdoor lights where electrical sockets or light sockets are available.

Referring to FIG. 25, a thirteenth embodiment of a work light in accordance with the present invention is illustrated. Work light 356 includes handle 358 having transparent cover 360 secured to end 362 thereof. Handle 358 and cover 360 are similar to handle 50 and cover 58 of work light 48 shown in FIG. 2. Handle 358 and transparent cover 360 may be constructed using any suitable method including injection molding, blow molding, or the like from a suitable material such as, e.g., plastic or glass. Rubber bumpers 363 are disposed at either end of handle 358 as well as the top end of cover 360 so as to protect work light 356 from damage. Work light 356 is provided with mounting plate 364 on which focused LEDs 21 are mounted by way of base plates 23. Mounting plate 364 is secured at both ends in support brackets 366. Mounting plate 364 is constructed from a suitable heat sink material such as aluminum to conduct heat away from LEDs 21. LEDs 21 are each mounted on substantially rectangular base plate 23 which also acts as a heat sink to conduct heat away from LEDs 21. Plates 23 of LEDs 21 are mounted to plate 364 using any suitable method to enable suitable heat transfer from base plates 23 to plate 364. On/off switch 368 is disposed in handle 358 to control the supply of power to LEDs 21. Work light 356 is shown having power cord 370 extending from one end of handle 358. However, it is understood that alternative methods of supplying power to work light 356 may be used.

FIGS. 26 through 37 illustrate a fourteenth embodiment of a work light in accordance with the present invention. Work light 372 is designed to be intrinsically safe, so that it may be used in environments containing ignitable material such as hydrogen filled areas, granaries, petroleum filled areas, or the like. An intrinsically safe light is designed to prevent the generation of sparks when used in such an environment.

Figure 26:
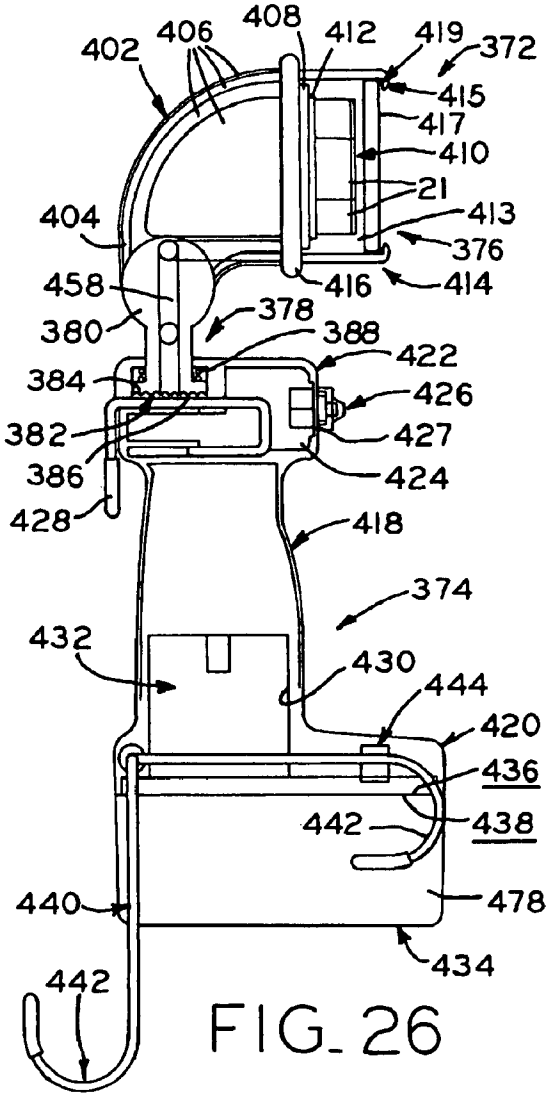
FIG. 26 is partial sectional, side elevational view of a fourteenth embodiment of a work light in accordance with the present invention wherein the work light is battery operated.
Figure 28:
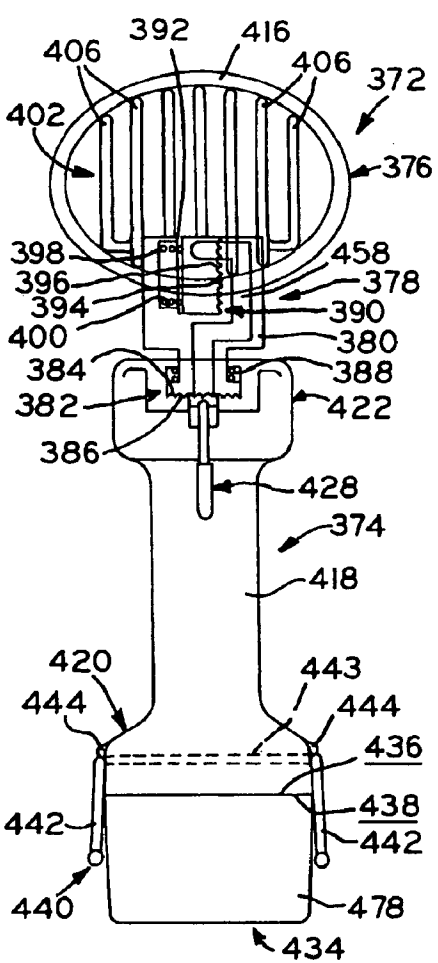
FIG. 28 is a partial sectional, rear elevational view of the work light of FIG. 26.
Figure 30:
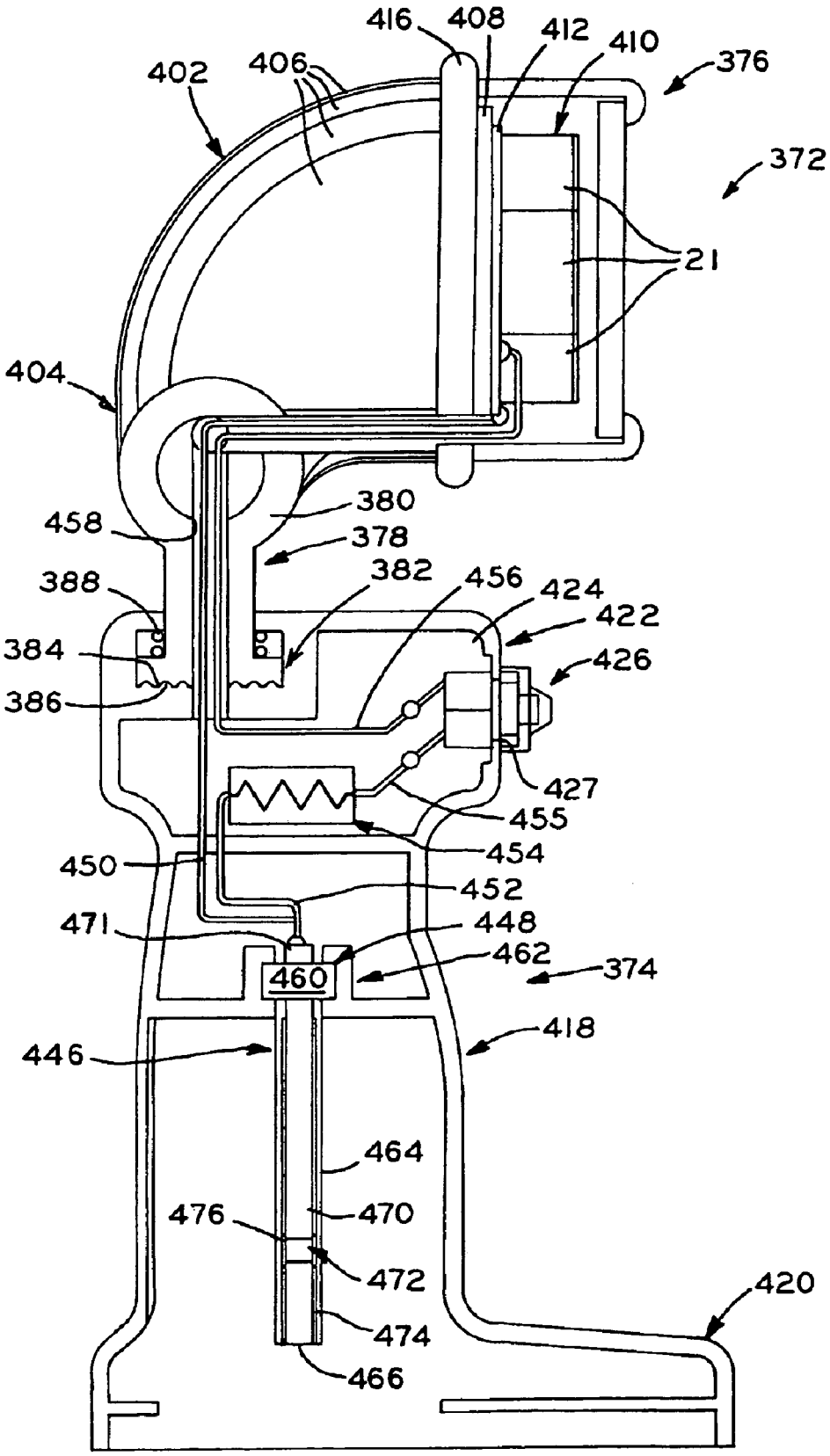
FIG. 30 is a side elevational view of the work light of FIG. 29.

Work light 372 includes handle 374 having light head 376 pivotally and rotatively mounted thereon by linkage 378. Referring to FIGS. 26, 28, and 30, linkage 378 includes post 380 having clutch ratcheting mechanism 382 located at the lower end thereof. Clutch ratcheting mechanism 382 includes teeth 384 integrally formed in post 380 which engage with teeth 386 formed in handle 374. Post 380 is biased by spring 388 toward handle 374 to promote engagement of teeth 384 and 386, and thus normally locking the radial position of light head 376. Referring to FIG. 28, post 380 includes cutout portion 392 near the light head end thereof in which a second clutch ratcheting mechanism 390 is located to facilitate pivotal movement of light head 376. Second clutch ratcheting mechanism 390 includes teeth 394 integrally formed in post 380 which mate with teeth 396 integrally formed in light head 376. Spring 398 is located in recess 400 formed in post 380 to bias teeth 396 into engagement with teeth 394, and thus normally locking the position of light head 376. When light head 376 is pivoted or rotated radially by first compressing spring 388 and/or spring 398 caused by axial camming of the ratchet teeth, teeth 384 formed in linkage 378 and teeth 396 formed in light head 376 rotate relative to mating teeth 386 and 394, respectively.

Figure 27:
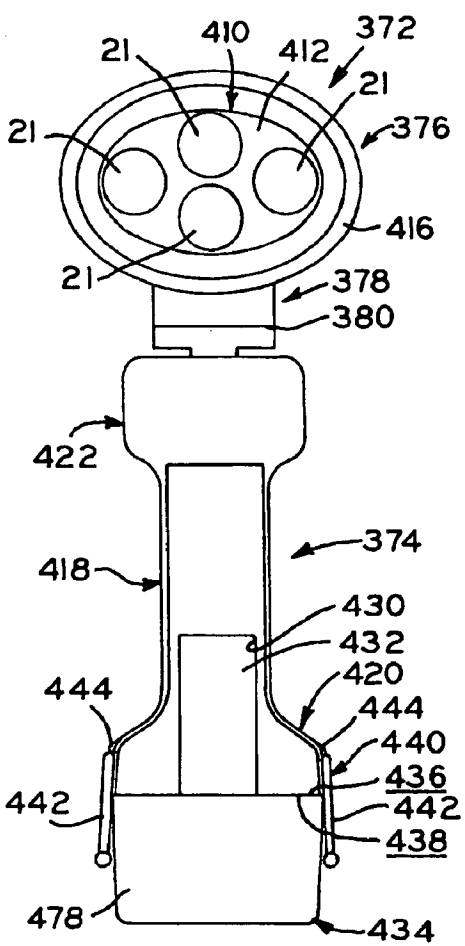
FIG. 27 is a front elevational view of the work light of FIG. 26.
Figure 29:
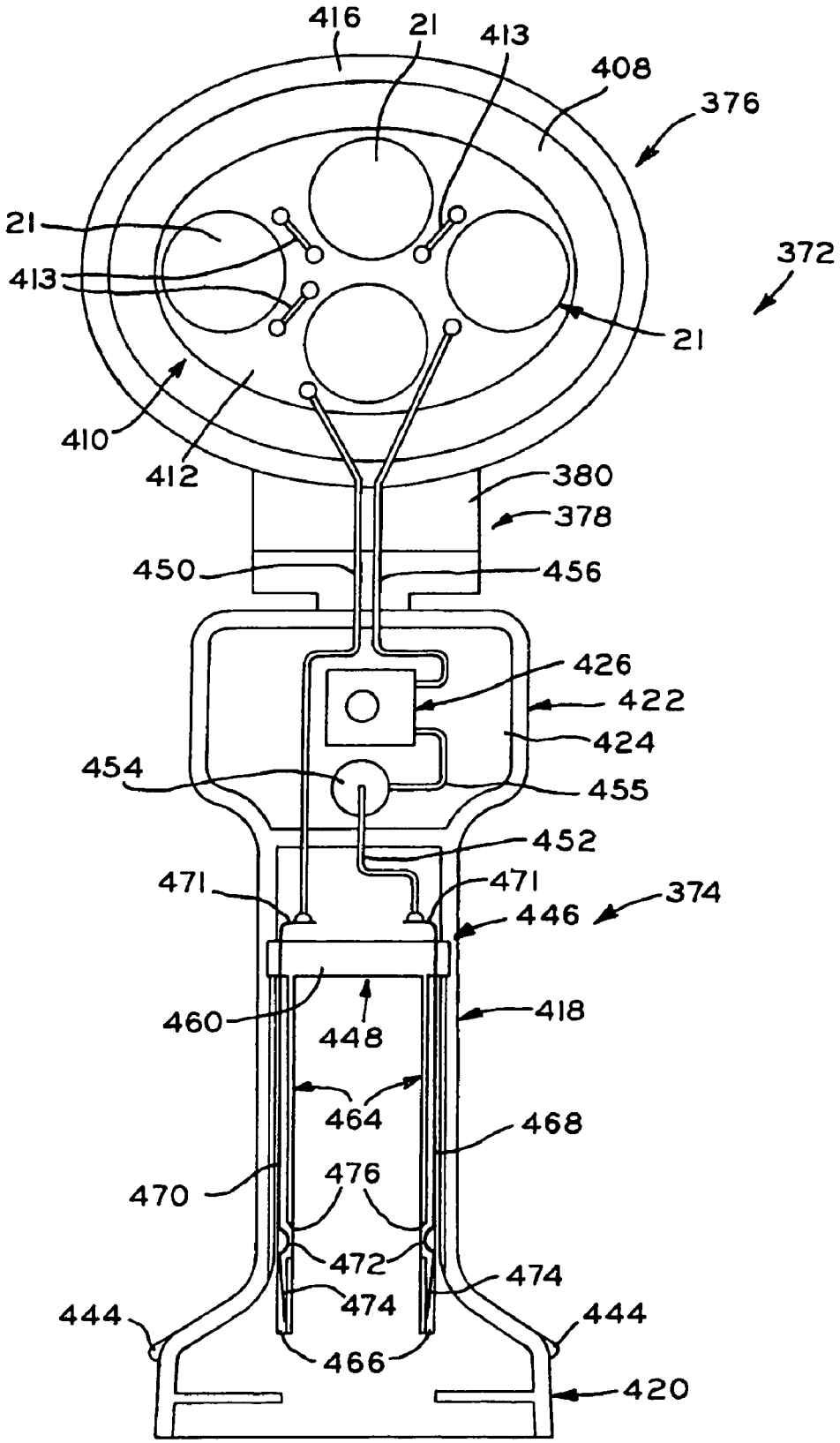
FIG. 29 is a sectional view of the work light of FIG. 27 with the battery removed, showing the electrical connections in the handle and light head.

Referring to FIGS. 26-30, light head 376 includes heat sink bracket 402 having neck portion 404 on which teeth 396 are formed. Rubber bumper 416 may be secured to heat sink bracket 402 being located about the periphery thereof to protect work light 372 from damage. Heat sink bracket 402 supports a plurality of fins 406 which act as a heat sink to dissipate heat produced by LEDs 21. A plurality of fins 406 are positioned approximately parallel to one another and oriented substantially perpendicularly to plate 408 integrally formed with fins 406. Heat sink bracket 402 is in contact with LED assembly 410 to conduct heat away from LEDs 21. LED assembly 410 is located in cavity 413 of housing 414 which is secured to heat sink bracket 402 by any suitable fastening method includes screws, or the like. Housing 414 includes flanged portion 415 which wraps around a portion of transparent lens 417. Gasket 419 is located between flanged portion 415 and lens 417 to provide seal therebetween to seal LED assembly 410 from the atmosphere. LED assembly 410 includes mounting plate 412 onto which a plurality of focused LEDs 21 are mounted. Focused LEDs 21 are electrically connected by wires 413 (FIG. 29). Plate 412 of LED assembly 410 is secured to plate 408 of heat sink bracket 402 by any suitable method to enable appropriate heat transfer from assembly 410 to bracket 402. In the embodiment shown in FIGS. 26-28, the shape of mounting plate 412 and thus the shape of light head 376 is oval. However, light head 376 may have any desired shape including rectangular, circular, square, or the like. Alternatively, LEDs 21 may be individually mounted on rectangular plates 23 (FIG. 25) which are in turn mounted to plate 408. Referring to FIG. 27, four focused LEDs 21 are mounted to plate 412, however, any desired number of LEDs 21 may be used to produce an acceptable amount of light. Light head 376 and linkage 378 are constructed from a material such as aluminum which helps to dissipate heat produced by LEDs 21. In an alternative embodiment of work light 372, a halogen lamp may be used instead of LEDs 21. However, this embodiment of the work light may not necessarily be intrinsically safe.

Handle 374 is formed using any suitable method such as injection molding from a material such as plastic. Handle 374 includes grip portion 418 located intermediate battery receptacle 420 and switch housing 422. Switch housing 422 (FIG. 26) includes cavity 424 in which the end of post 380, which has teeth 384 formed thereon, is received and in which teeth 386 are formed. On/off switch 426 is mounted in aperture 427 formed in switch housing 422 such that when the operator grasps handle 374, switch 426 can be easily actuated. Hook 428 is slidingly mounted in switch housing 422, and is shown in its retracted position in FIG. 26. Hook 428 extends outwardly from switch housing 422 so that work light 372 may be suspended above a work area. Pivotally mounted through the rear portion of battery receptacle 420 is a second hook 440. Referring to FIGS. 26 and 27, hook 440 includes two J-shaped portions 442 connected by bar 443 extending through battery receptacle 420. Hook 440 has a first, stored position in which J-shaped portions 442 are captured in catches 444. In a second position, J-shaped portions 442 are pivoted about linking bar 443 until portions 442 extend downwardly from work light 372. Work light 372 may then be suspended by hooks 440 above a work area.

Figure 31:
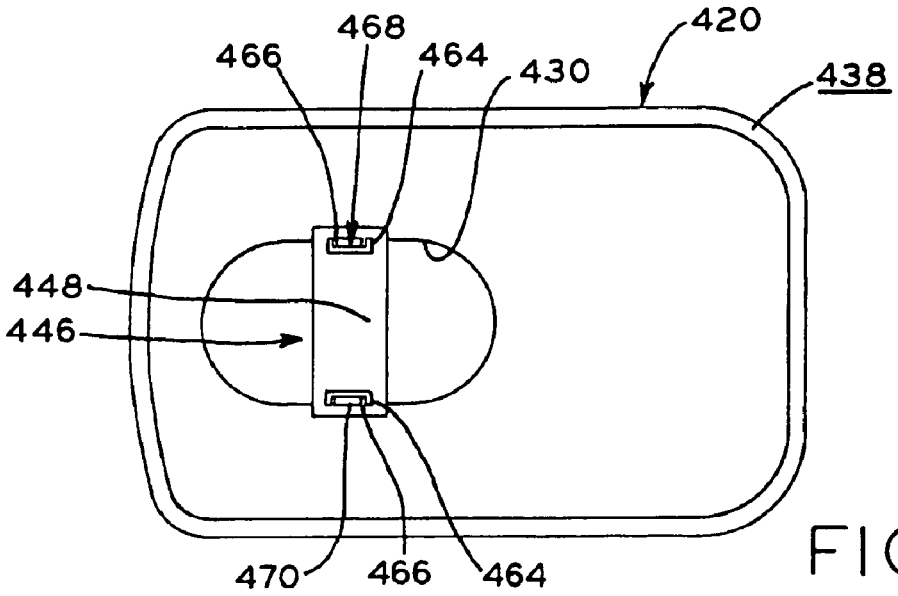
FIG. 31 is a bottom plan view of the work light of FIG. 29.

Referring to FIGS. 29, 30, and 31, located at the lower end of grip portion 418 is battery receptacle 420 having opening 430 formed therein, sized to receive contact portion 432 of battery 434. Opening 430 extends from battery receptacle 420 into grip portion 418 a predetermined length. With battery 434 installed, contact portion 432 of the battery is located in opening 430, and upper surface 436 of battery 434 is substantially flush with lower surface 438 of battery receptacle 420. Battery 434 is locked into position in battery receptacle 420 by any suitable catch means. Battery 434 is removable and rechargeable as discussed hereinbelow, however, work light 372 may be provided with a permanently mounted battery. In order to recharge the permanently mounted battery, the work light would have to be placed on a charger rather than just the battery.

Referring to FIGS. 29 and 30, mounted in grip portion 418 of handle 374, within opening 430, is contact assembly 446. Contact assembly 446 includes support 448 which is mounted in mount 462 (FIG. 30) of grip portion 418. Contact assembly 446 is electrically connected to light head 376 via wire 450. Wire 452 is electrically linked to contact assembly 446 and resistor 454 which is in turn connected to switch 426 via wire 455. Switch 426 and light head 376 are electrically connected by wire 456. Resistor 454 limits the current supplied to LEDs 21. Linkage 378 includes tunnels 458 provided therein in which wires 450 and 456 are located.

Figure 37:
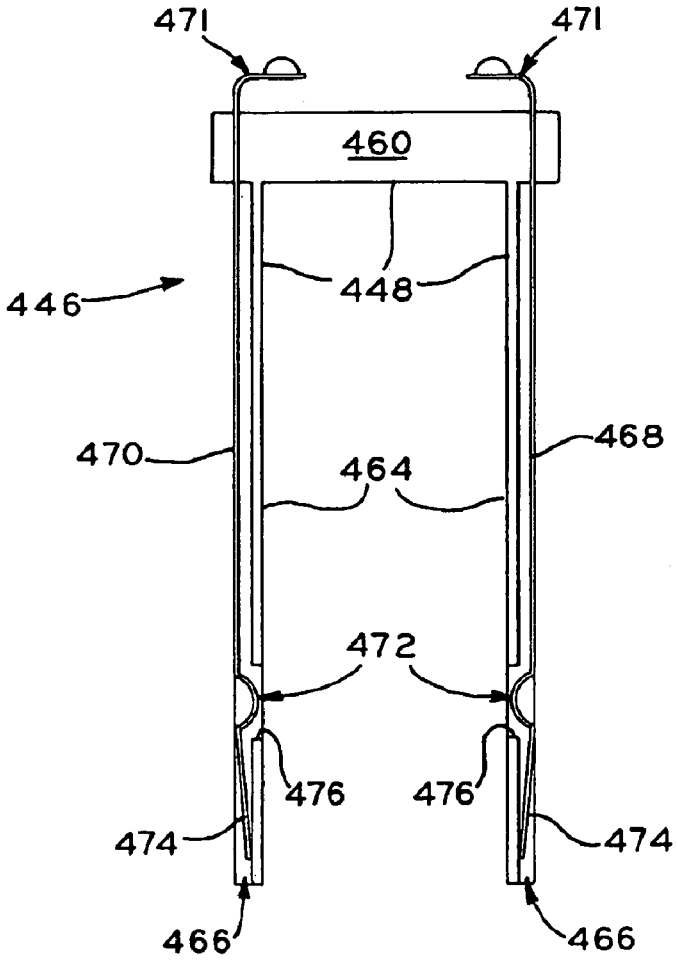
FIG. 37 is a sectional view of the contact assembly of the work light of FIG. 26.

Referring now to FIG. 37, support 448 of contact assembly 446 is substantially U-shaped having substantially horizontal support 460 which is received in mount 462. Substantially vertical legs 464 are integrally formed with substantially horizontal support 460. Support 448 may be constructed from any suitable, non-conductive material such as plastic by, e.g., injection molding, blow molding, or the like. Referring to FIG. 31, legs 464 are substantially U-shaped defining tunnels 466 therein in which positive and negative contacts 468 and 470 are located. Tunnels 466 are provided to encase contacts 468 and 470, preventing contacts 468 and 470 from being inadvertently electrically connected and producing a spark. As shown in FIG. 37, contacts 468 and 470 include L-shaped ends 471 which are electrically connected to wires 450 and 452, and further include moving contact 472 with ramped portion 474 extending from the lower end thereof. Contacts 468 and 470 are constructed from an electrically conductive, spring-like material which allows movement of moving contacts 472 through apertures 476 provided in legs 464 as will be described further hereinbelow.

Figure 32:
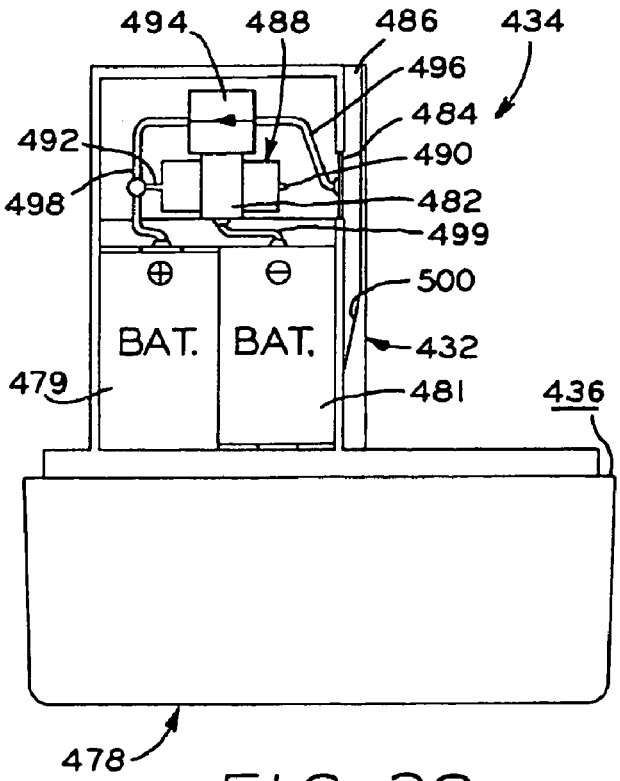
FIG. 32 is a partial sectional, side elevational view of a battery pack for the work light of FIG. 26.
Figure 33:
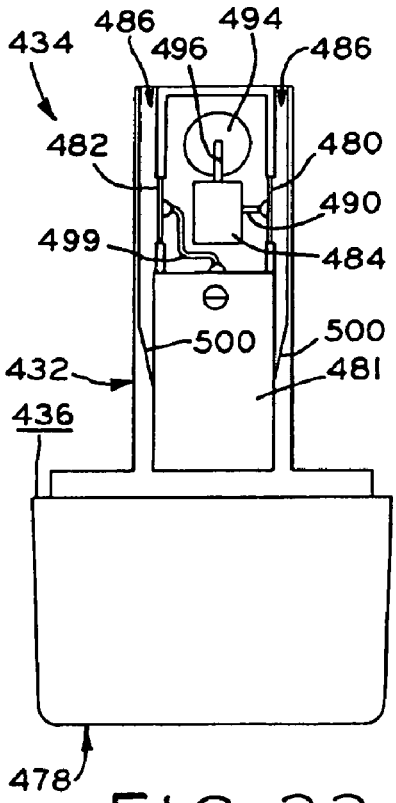
FIG. 33 is a partial sectional, front elevational view of the battery pack of FIG. 32.

Battery holder 434 is illustrated in FIGS. 32, 33, 34, and 36, and includes base 478 with contact portion 432 arranged approximately perpendicularly therewith. Base 478 has a plurality of electrical battery cells stored therein (not shown). Battery cells 479 and 481 are located in contact portion 432 and are electrically connected to the battery cells stored in base 478. Battery cells 479 and 481 are electrically connected to positive and charging terminals 480 and 484, and negative terminal 482. Each terminal 480, 482, and 484 is mounted in contact portion 432 in one of three tunnels 486 integrally formed in contact portion 432. Tunnels 486 for positive and negative terminals 480 and 482 are formed on respective opposite sides of contact portion 432, arranged substantially perpendicularly to surface 436 of battery 434 as shown in FIG. 33. Tunnel 486 for charging terminal 484 is located on the front surface of contact portion 432, and is also arranged substantially perpendicularly to surface 436 of battery 434 as shown in FIG. 32. Tunnels 486 are provided to encase terminals 480, 482, and 484 to prevent electrical contact therebetween which may produce a spark. Charging terminal 484 is electrically connected by wire 496 to blocking diode 494 which is in turn connected via wire 498 to battery 479. Positive terminal 480 is electrically connected to limiting resistor 488 by wire 490. Limiting resistor 488 is provided to limit the amount of current flow from the battery to the terminals, and therefore limits the amount of current supplied to work light 372 when battery 434 is installed. Additionally, in the event of a short circuit between positive and negative terminals 480 and 482 of battery 434 when the battery is disconnected from the light head, limiting resistor 488 limits the amount of current flowing between the terminals and thus prevents a spark. Such a short circuit may be created if a piece of wire, for example, were used to electrically connect the two terminals. Limiting resistor 488 is also connected to wire 498 by wire 492 to electrically link battery 479 and positive terminal 480. Negative terminal 482 is electrically connected to battery 481 by wire 499.

Figure 35:
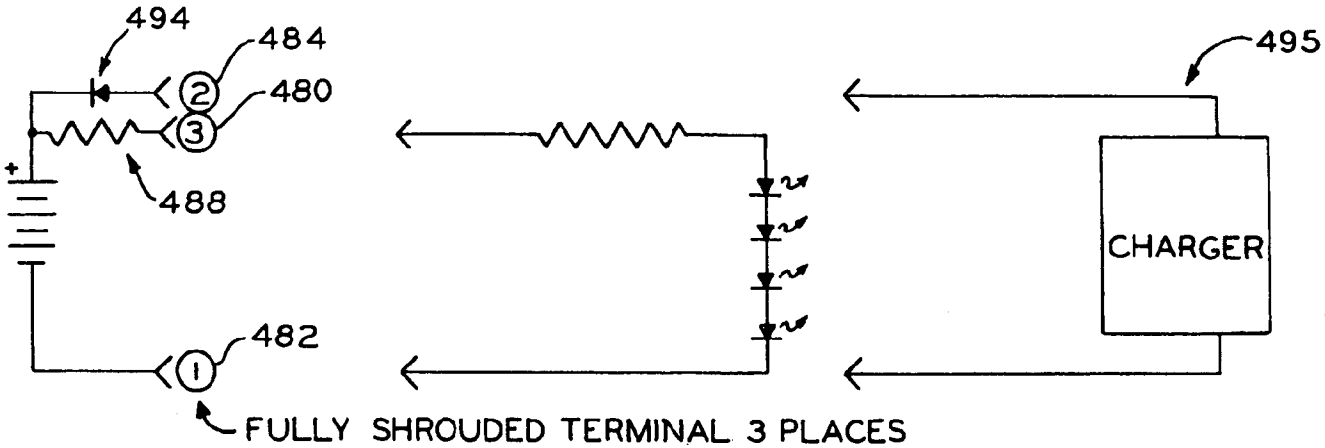
FIG. 35 is a schematic view of the electrical circuit of the work light of FIG. 26.

Referring to FIG. 35, in the illustrated embodiment, battery 434 is provided with three terminals 480, 482, and 484 with blocking diode 494 and limiting resistor 488 being connected in parallel. Blocking diode 494 is provided to bypass limiting resistor 488 only during charging of the battery when it is connected to charger 495. Diode 494 allows large amounts of current to flow into battery 434 during a charging operation and blocks current in the other direction. This allows battery 434 to be charged in substantially less time than if resistor 488 was limiting current entering battery 434. Although illustrated as a single diode 494, three diodes 494 may be used in series.

Figure 36:
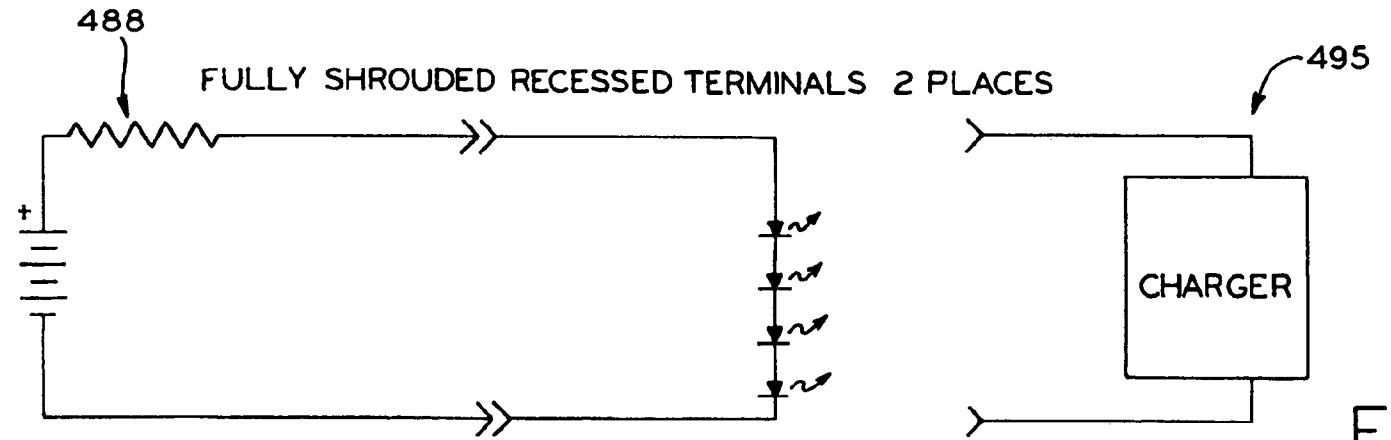
FIG. 36 is a schematic view of an alternative electrical circuit for the work light of FIG. 26.

In an alternative embodiment, charging terminal 484 is eliminated as is shown in FIG. 36. Charging current for battery 434 flows through resistor 488 which slows charging of the battery. However, this configuration eliminates the need for the third, charging terminal 484.

The location of tunnels 486 along the sides of contact portion 432 (FIG. 34) and tunnels 466 in opening 430 (FIG. 31) is such that when battery 434 is installed into handle 374, tunnels 466 are received in tunnels 486. Recesses are formed in tunnels 486 which align and guide tunnels 466 as they enter tunnels 486. As tunnels 466 are forced further into tunnels 486, integrally formed ramped portions 500 are contacted by ramped portions 474 of contacts 468 and 470. The contact between ramped portions 474 and 500 force contacts 468 and 470 inwardly such that moving contacts 472 pass through apertures 476 in tunnels 466. Recesses 477 illustrated in FIG. 34 allow tunnels 466 to move past ramped portions 500. Once battery 434 is seated within opening 430, moving contacts 472 are in contact with positive and negative terminals 480 and 482. When switch 426 is in the on position, current from battery 434 is supplied to light head 376 to illuminated LEDs 21.

Limiting resistor 488 limits the amount of current being supplied to light head 376. Contacts 468 and 470, and terminals 480, 482, and 484 are protected by tunnels 466 and 486 which prevent the contacts and terminals from being inadvertently, electrically linked, thus preventing a spark. Further, tunneling 486 and 486 provides keying which prevents other, non-intrinsically safe batteries from being used with work light 372.

Figure 38:
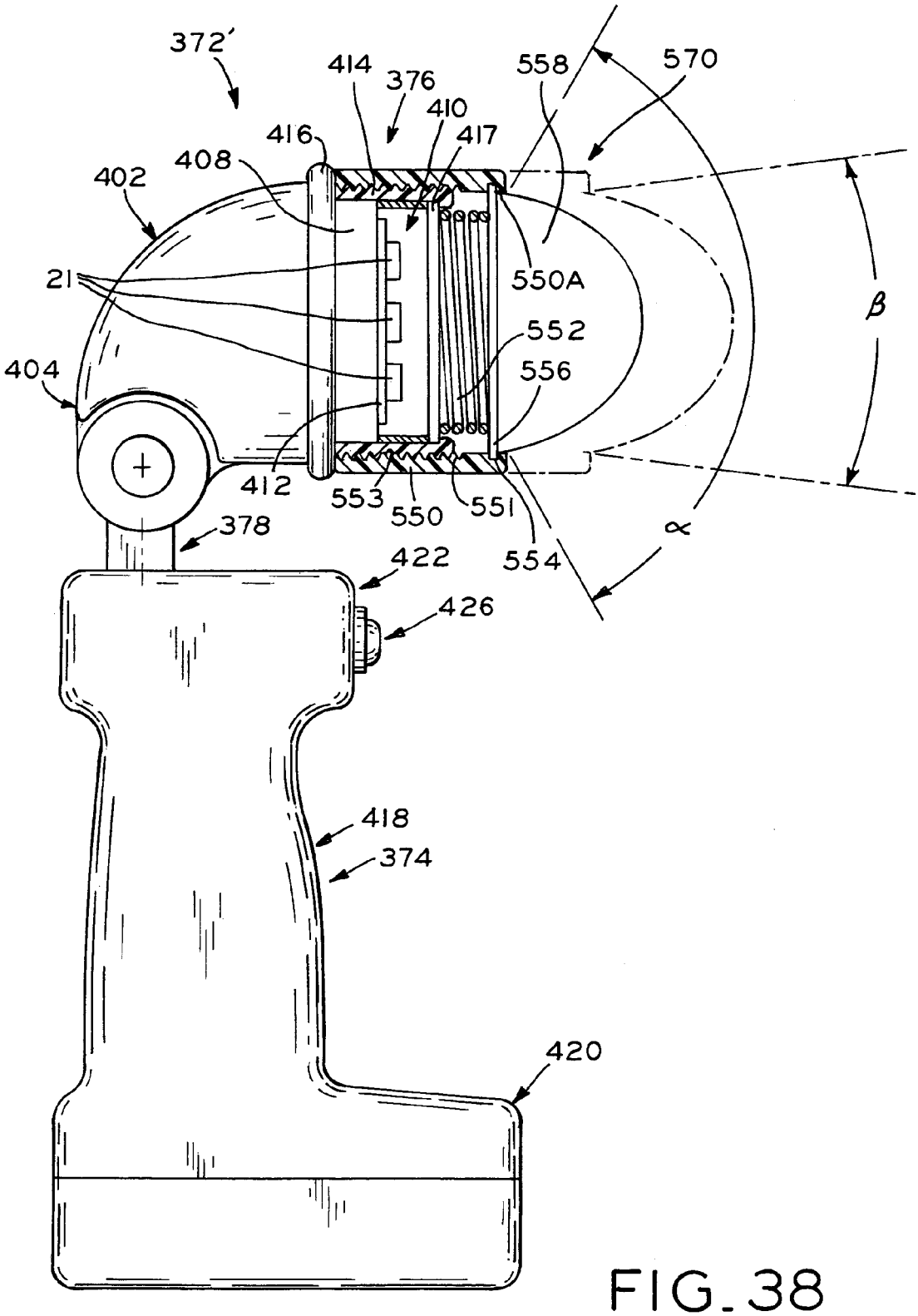
FIG. 38 is a partial sectional, side elevational view of a fifteenth embodiment of a work light in accordance with the present invention wherein the work light includes an adjustable parabolic lens.

FIG. 38 illustrates a fifteenth embodiment of a work light in accordance with the present invention. Work light 372' is designed to be intrinsically safe, so that it may be used in environments containing ignitable material such as hydrogen filled areas, granaries, petroleum filled areas, or the like. An intrinsically safe light is designed to prevent the generation of sparks when used in such an environment. Work light 372' is of the same type as work light 372, described above with reference to FIGS. 26-37, and, thus, work light 372' is numbered with identical reference numbers where applicable.

Work light 372' includes three focused LEDs 21 mounted on mounting plate 412 in LED assembly 410. LEDs 21 may be constructed similar to LEDs 21 described above or LEDs 20, as described above. Alternatively, LEDs 20 or LEDs 21, as described throughout this document, may employ ultraviolet ("UV") emitting LEDs in place of white light-emitting diodes.

Figure 34:
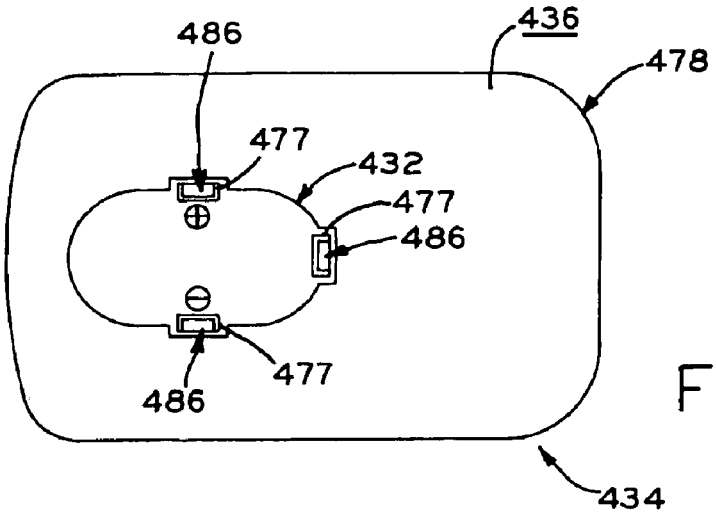
FIG. 34 is a top plan view of the battery pack of FIG. 32.

LEDs 21 in work light 372' are, in an exemplary embodiment, high intensity LEDs with low power consumption. Any LEDs 20 or 21 described hereinabove may also be high intensity LEDs. For example, LEDs 21 may provide high intensity light while only requiring a low voltage source, for example, 3.4 volts, 4.6 volts, or 6 volts. In one embodiment, LEDs 21 include three high intensity LEDs, such as lamina BL-4000, available from Seoul Semiconductor Co. Ltd., 148-29, Kagan-Dong, Keumchun-G, Seoul, Korea; Lamina Ceramics, Inc., 120 Hancock Lane, Westampton, N.J.; Cree, Inc., 4600 Silicon Drive, Durham, N.C.; LEDtronics, Inc., 23105 Kashiwa Ct., Torrance, Calif.; and Nichia Corp., Tokyo, Japan, connected in parallel. The parallel LEDs 21 are connected through a limiting resistor, such as resistor 454 (FIG. 30), to a battery, such as battery 434 (FIGS. 32-34). Switch 426 between LEDs 21 and resistor 454 provides a means of disconnection, as described above. Limiting resistor 488 (FIG. 35) is provided to limit the amount of current flow from the battery to the terminals, and therefore limits the amount of current supplied to work light 372' when battery 434 is installed. Such low voltage requirements allow work light 372' to be intrinsically safe, i.e., LEDs 21 operate at voltage and current levels below the Underwriters Laboratories ("UL") ignition curve for hydrogen therefore making LEDs 21 intrinsically safe for use in all Class 1 Groups. LEDs 21 produce no spark great enough to create ignition of various gases which may be present in the work area. LEDs 21 may be powered by a single lead configuration, or, alternatively, the single lead configuration may be divided into a plurality of parallel circuits, each falling below the UL ignition curve, described above, for power consumption. Heat sink fins 406, as shown in FIG. 30, are disposed approximately parallel to one another and oriented substantially perpendicular to plate 408 integrally formed with fins 406. Heat sink bracket 402 supports fins 406 which act as a heat sink to dissipate heat produced by LEDs 21.

Work light 372' includes optical adjustable mechanism 570 including base portion 550, compression spring 552, and parabolic lens 558. Housing 414 includes external threads 553 disposed thereon which engage internal threads 551 formed in base portion 550. Base portion 550 has parabolic lens 558 assembled thereto which is held in place by heat staking a lip 550A of base portion 550 over lip 554 on parabolic lens 558. Compression spring 552 supplies a constant biasing force between lens 417 and lens 558 to hold parabolic lens 558 steady during operation. As shown in solid lines in FIG. 38, base portion 550 is fully threaded onto housing 414. In such a configuration, the width of the light beam emitted from LEDs 21 through lens 417 and parabolic lens 558 is approximately as wide as angle $\alpha$. Angle $\alpha$ may, in one embodiment, be approximately 120°. As shown in dashed lines in FIG. 38, rotation of base portion 550 causes parabolic lens 558 to move away from lens 417. Base portion 550 may be rotated to make parabolic lens 558 any distance from lens 417 depending on the desired width of light to be emitted from parabolic lens 558. The result of adjusting parabolic lens 558 to the position shown in dashed lines in FIG. 38 is that the width of the light beam is approximately as wide as angle $\beta$. In one embodiment, angle $\beta$ may be 15°. In the embodiment shown in solid lines in FIG. 38, work light 372' functions as a task or work light to provide lighting to a confined, small area. In the embodiment shown in dashed lines in FIG. 38, work light 372' functions as a flashlight or beam light to provide lighting at a distance from an operator of the light.

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An intrinsically safe light, comprising:

a base;

a battery operably mounted in said base;

an LED mounting member connected to said base;

a plurality of high intensity, low power consumption LEDs mounted on said mounting member and electrically connected to said battery, each of said plurality of LED's operable to emit light in an axial direction; and further comprising an optical adjustment structure comprising:

a base portion axially movably engaged with said base; and a lens fixedly attached to said base portion, whereby movement of said base portion relative to said base in said axial direction effects movement of said lens relative to said base and thereby effects movement of a focal point of said lens relative to said LEDs.

2. The intrinsically safe light according to claim 1, wherein said battery provides approximately 3.6 volts to said plurality of LEDs.

3. The intrinsically safe light according to claim 1, wherein said battery provides approximately 4.8 volts to said plurality of LEDs.

4. The intrinsically safe light according to claim 1, wherein said battery provides approximately 6.0 volts to said plurality of LEDs.

5. The intrinsically safe light according to claim 1, wherein said LEDs comprise focused LEDs.

6. The intrinsically safe light according to claim 1, wherein said mounting member comprises a heat sink.

7. The intrinsically safe light according to claim 1, wherein said mounting member comprises a heat sink including a plurality of fins.

8. The intrinsically safe light according to claim 1, wherein said battery is rechargeable, the light further comprising an energizing circuit for energizing said LEDs from said battery, said energizing circuit including a current limiting device.

9. The intrinsically safe light according to claim 8, further comprising a recharging circuit, said recharging circuit including a unidirectional electrical element for bypassing said current limiting device.

10. The intrinsically safe light according to claim 1, wherein said battery includes a plurality of battery contacts, and wherein said base includes a plurality of electrical contacts respectively contacting said battery contacts and connecting said battery to said energizing circuit.

11. The intrinsically safe light according to claim 10, further comprising a contact enclosure, one of said electrical contacts disposed in said enclosure, whereby said battery contact is connected to said electrical contact within said enclosure.

12. An intrinsically safe light, comprising:

a base;

a battery operably mounted in said base;

an LED mounting member connected to said base;

a plurality of high intensity, low power consumption LEDs mounted on said mounting member and electrically connected to said battery, wherein said battery includes a plurality of battery contacts, and wherein said base includes a plurality of electrical contacts respectfully contacting said battery contacts and connecting said battery to said energizing circuit;

a plurality of contact enclosures, each said electrical contact respectively disposed in one of said enclosures, whereby said battery contacts are respectively connected to said electrical contacts within said plurality of enclosures.

13. The intrinsically safe light according to claim 1, further comprising a hook for suspending the light.

14. The intrinsically safe light according to claim 1, further comprising a plurality of hooks for suspending the light in a plurality of suspending orientations.

15. An intrinsically safe light, comprising:

a base;

a battery operably mounted in said base;

an LED mounting member connected to said base;

a plurality of high intensity, low power consumption LEDs mounted on said mounting member and electrically connected to said battery; and a head connected to and rotatable relative to said base.

16. An intrinsically safe light, comprising:

a base;

a battery operably mounted in said base;

an LED mounting member connected to said base;

a plurality of high intensity, low power consumption LEDs mounted on said mounting member and electrically connected to said battery; and a head connected to and tiltable relative to said base.

17. The intrinsically safe light according to claim 15, wherein said transparent cover comprises a portion of said head, said head both rotatable and tiltable relative to said base.

18. An intrinsically safe light, comprising:

a base;

a battery operably mounted in said base;

an LED mounting member connected to said base;

a plurality of high intensity, low power consumption LEDs mounted on said mounting member and electrically connected to said battery; and a plurality of separated intrinsically safe circuits to provide power from said battery to said plurality of high intensity, low power consumption LEDs.

19. The intrinsically safe light according to claim 12, wherein said plurality of enclosures comprises a plurality of tunnels.

20. The intrinsically safe light according to claim 12, wherein said LEDs comprise focused LEDs.

21. The intrinsically safe light according to claim 12, wherein said energizing circuit includes a current limiting device.

22. The intrinsically safe light according to claim 21, further comprising a recharging circuit, said recharging circuit including a unidirectional electrical element for bypassing said current limiting device.

* * * * *